United States Patent [19]

Hallam et al.

[11] Patent Number: 5,012,636

[45] Date of Patent: May 7, 1991

[54] APPARATUS AND PROCESS FOR FORMING ALTERNATE TWIST PLIED YARN AND PRODUCT THEREFROM

[75] Inventors: Donald E. Hallam; Peter Popper, both of Wilmington, Del.; Harold F. Staunton, Avondale, Pa.; Paul W. Yngve, Wilmington, Del.

[73] Assignee: E. I. Du Pont de Nemours and Company, Wilmington, Del.

[21] Appl. No.: 322,624

[22] Filed: Mar. 13, 1989

Related U.S. Application Data

[60] Division of Ser. No. 188,559, Apr. 29, 1988, Pat. No. 4,873,821, which is a continuation-in-part of Ser. No. 181,847, Apr. 15, 1988, abandoned.

[51] Int. Cl.[5] ..... D02G 3/28; D02G 3/40

[52] U.S. Cl. ..... 57/204; 57/293; 57/297

[58] Field of Search ..... 57/204, 293, 333, 350, 57/328, 294, 22, 297, 202

[56] References Cited

U.S. PATENT DOCUMENTS

| | | | |
|---|---|---|---|
| 3,184,354 | 5/1965 | Strother | 156/73 |
| 3,434,275 | 4/1967 | Backer et al. | 57/204 |
| 3,468,120 | 9/1969 | Hildebrand | 57/293 |
| 3,775,955 | 12/1973 | Shah | 57/293 |
| 4,002,012 | 1/1977 | Norris et al. | 57/22 |
| 4,068,459 | 1/1978 | Movshovich et al. | 57/293 |
| 4,068,459 | 1/1978 | Movshovich et al. | 57/293 |
| 4,074,511 | 2/1978 | Chambley et al. | 57/293 |
| 4,083,172 | 4/1978 | Norris et al. | 57/293 |
| 4,084,400 | 4/1978 | Movshovich et al. | 57/293 |
| 4,104,855 | 8/1978 | Chambley et al. | 57/333 |
| 4,109,353 | 8/1978 | Mitchell et al. | 28/104 |
| 4,114,549 | 9/1978 | Chambley et al. | 112/410 |
| 4,123,893 | 11/1978 | Chambley et al. | 57/204 |
| 4,142,355 | 3/1979 | Chambley et al. | 57/293 |
| 4,170,103 | 10/1979 | Norris et al. | 57/293 |
| 4,170,868 | 10/1979 | Chambley et al. | 57/293 |
| 4,173,115 | 11/1979 | Chambley et al. | 57/293 |
| 4,173,861 | 11/1979 | Norris et al. | 57/293 |
| 4,186,549 | 2/1980 | Chambley et al. | 57/293 |
| 4,206,589 | 6/1980 | Markey et al. | 57/293 |
| 4,215,642 | 8/1980 | Chambley et al. | 112/410 |
| 4,219,998 | 9/1980 | Farnhill | 57/293 |
| 4,246,750 | 1/1981 | Norris et al. | 57/293 |
| 4,276,740 | 7/1981 | Chambley et al. | 57/205 |
| 4,279,120 | 7/1981 | Norris | 57/204 |
| 4,419,160 | 12/1983 | Wang et al. | 156/73.2 |

FOREIGN PATENT DOCUMENTS

| | | |
|---|---|---|
| 1015291 | 12/1965 | United Kingdom . |
| 1047503 | 11/1966 | United Kingdom . |
| 2022154 | 5/1978 | United Kingdom . |

OTHER PUBLICATIONS

Henshaw, *Self-Twist Yarn,* Merrow Pub. Co. (1971), pp. 23–36.

*Primary Examiner*—Joseph J. Hail, III

[57] ABSTRACT

A process for making alternate S and Z twist plied yarn from individual singles yarns includes the steps of tensioning the singles yarns as they move in a path through the process, twisting the individual yarns in either an S or Z direction, stopping the forward movement of the yarn, then bonding the ply-twisted yarns at a node while applying twist, stopping the twisting operation, then repeating the procedure while twisting in the opposite direction.

13 Claims, 17 Drawing Sheets

Fig. 10
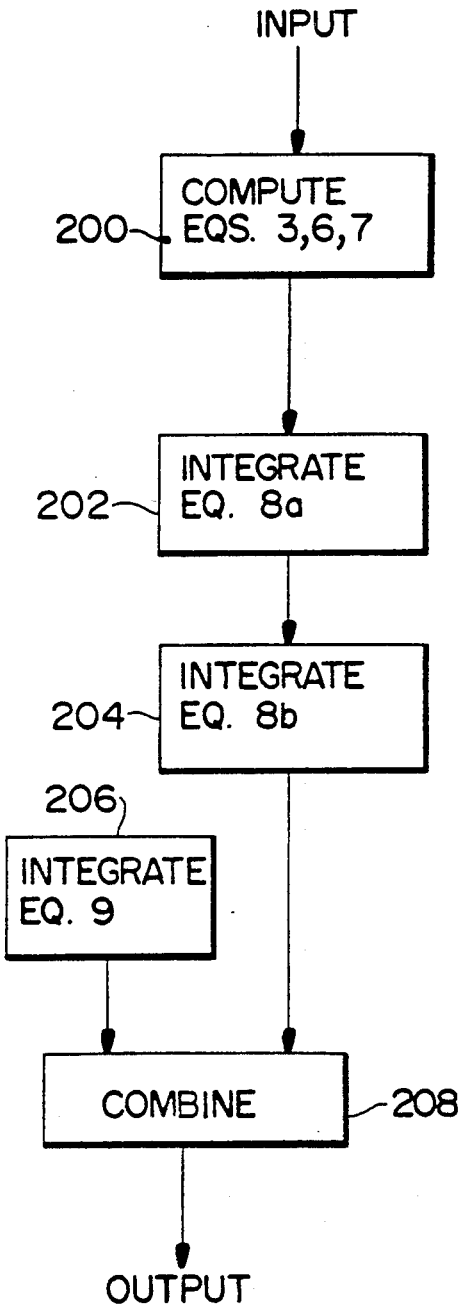
Fig. 11
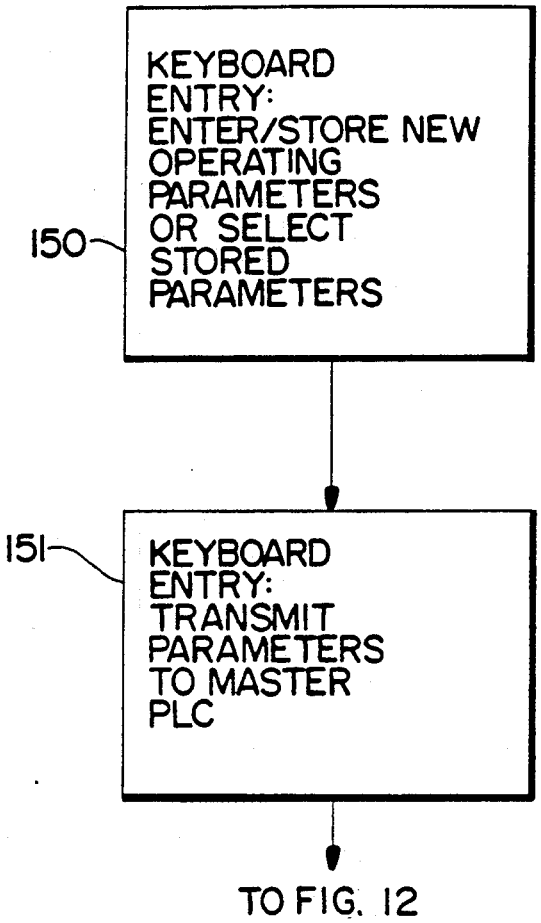
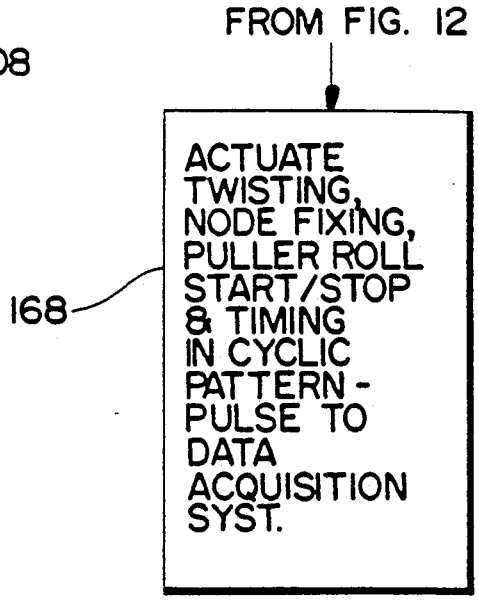
Fig. 13

APPARATUS AND PROCESS FOR FORMING ALTERNATE TWIST PLIED YARN AND PRODUCT THEREFROM

This is a division of application Ser. No. 07/188,559, now U.S. Pat. No. 4,873,821, filed 4/29/88 which is a continuation-in-part of application Ser. No. 07/181,847, filed 4/15/88 now abandoned.

DESCRIPTION

1. Technical Field

This invention relates generally to twist plied yarn and more particularly it relates to alternate twist plied yarn and the process for making such yarn from individual strands of yarn.

2. Background

Most yarn intended for use as pile in cut pile carpet is prepared by twisting two or more single zero-twist equal length crimped yarns about each other to form plied yarn; i.e., twist plied yarns. These yarns have a fairly uniform degree of true twist along the length. The yarn is then exposed while relaxed to either hot air or steam to set the fibers in the twist plied configuration so that they will remain in this form after the pile yarns are cut. The speed of the plying operation is limited to about 35 meters per minute by the inertial problems of rotating one feed yarn package around the other or by the aerodynamic drag as one yarn is rotated around the other by a flyer guide.

A certain degree of twist is required to hold the twisted heat-set yarns together and provide tuft definition during normal floor wear on a cut pile carpet. Since twisting is an expensive operation, carpet manufacturers try to use the least amount needed to do the job, non-uniformity in the twist will create sections of substandard twist. These sections tend to separate and mat together and appear as defects in the carpet.

Previous methods of forming alternate twist plied (ATP) yarn have produced a product, but only at a sacrifice in either speed, quality or both compared with continuously twisted product Speeds greater than 200 YPM are important to produce a product competitive in the market Important quality considerations at any speed are uniformity of twist, minimum node length, and low frequency of nodes per yard Preferably the nodes are very short and far apart and the twist is uniform right up to the node. At the preferred high speeds these quality considerations are even more difficult to achieve. Previous methods were also not adaptable to rapid set-up changes for different yarns or processing conditions, and changes in the line speed and yarn length between nodes.

Conventional methods of forming ATP yarn with "unbonded" nodes included continuously advancing and twisting the singles strands and plied yarn and intermittently stopping or reversing the singles strand twist without stopping the advancing. At the singles yarn reversals, the singles yarns are fastened together only by interfilament friction. Long node intervals were practiced, but the loss of singles and ply twist and lack of twist uniformity especially near the unbonded node were serious quality problems, and speeds were also less than desired.

Conventional methods of forming ATP yarn with "bonded" nodes included continuously advancing and twisting the singles strands and plied yarn and intermittently reversing the singles strand twist without stopping the advancing of the strands. At the singles yarn reversals, the singles were brought together and bonded before allowing the singles to ply together.

Another method of forming ATP yarn with "bonded" nodes included stopping the advancing, clamping the strands at two locations, twisting the singles strands in the same direction at a location between the clamps, bonding the aligned singles reversals at two positions, releasing the yarns to allow plying, and advancing two reversals before repeating the steps. Such a process may produce acceptable quality but requires accurate stopping at a previously bonded reversal which is a slow tedious process.

While the previous methods disclose techniques which are capable of making short segments of uniformly-twisted yarns with frequent twist reversals, there are no disclosures which enable one skilled in the art to operate a process at a speed equal to or greater than that of conventional true twist plying while making satisfactory product with good twist uniformity. As attempts are made to increase processing speed, twisting the yarns more forcefully to twist them more rapidly also compacts them so that they have inadequate bulk when tufted into a carpet, and such compaction can vary extremely along the length of the twisted sections, even leading to breakage. Furthermore, in yarns which have short distances between twist reversals, the reversals occupy a substantial percentage of the total yarn length and appear at the surface of a cut pile carpet frequently. Tufts which are cut at a bonded node are more compact than those which are cut between nodes, and the more frequently they occur, the less uniform the carpet appears. Therefore, it is desirable to make the distances between nodes as great as possible to minimize their visibility.

Furthermore after nodes are fixed, they must have sufficient strength to resist separating under tension and abrasion encountered in the subsequent handling and tufting into carpet. If just one node fails to hold, the plies untwist for a distance and form separated sections which mat together in the carpet and appear as streaks or defects. Therefore, the fixing of each node with adequate strength is extremely important to providing defect-free carpeting.

A means of producing twist plied yarn at increased speed with adequately uniform twist and bulk and with long distances between reversal nodes and with each node of adequate strength to prevent separating would be greatly desired.

SUMMARY OF THE INVENTION

The process for forming ATP yarn from a plurality of strands according to the invention includes the steps of advancing the strands at a predetermined rate under tension in a path adjacent to each other, twisting the strands in the same direction as they advance along said path, plying said twisted strands, stopping the forward motion of said strands, bonding the ply-twisted strands to form a bond, stopping the twisting of the strands, then repeating said steps while twisting said strands in a different manner to form a ply reversal node adjacent the bond. Preferably the speed of advancement of the strands is decreased between the formation of said nodes, and in the repeating of the steps the strands are twisted in the opposite direction, so that adjoining twisted sections are uniformly highly twisted.

The apparatus for forming ATP yarn having a fixed distance between nodes defining sections of alternate twist in the yarn includes successively, a source of supply of the strands, a means for tensioning the strands, a means for twisting the strands, a means for squeezing and bonding said strands at said nodes and a means for forwarding said yarn. The ratio of the distance between the tensioning means and the twisting means to said fixed distance being at least 2; the ratio of the distance between the twisting means and the bonding means to said fixed distance being less than 0.02; and the ratio of the distance between said bonding means and said forwarding means to said fixed distance being at least 2.

The apparatus and process of this invention can be operated at high speeds while producing high quality ATP yarn and surprisingly does so using an intermittent advance of the strands. The bonding method is also unique in that the bond is formed after the twisted singles are allowed to ply together and before the singles twist is reversed. The reversal node is formed adjacent the bond after the bond is made. A novel arrangement of steps is employed that overcomes the precise positioning problem in the stop and go method above. Precise high speed coordination of the novel steps results in a high speed process that produces high quality ATP yarn not achievable before. The coordination between steps can be rapidly and readily changed by adjustment of the timing of the machine functions, preferably by simple keyboard entry on a programmable controller.

Preferably the product of the invention is an alternate twist plied yarn formed from a plurality of strands twisted in alternating directions in lengthwise intervals between reversal nodes there being a distance of at least 100 turns of the plied yarn between each node with a node length less than two diameters of said strand or, in the alternative, less than one quarter turn of the plied yarn. A bond is formed in the plied yarn before the reversal node is formed, wherein the center of the bond is not aligned with the center of the reversal node and the strands at the node are bonded together at an angular relationship to each other. The node length is less than the length of the bond. The product of this invention is further characterized in having a substantially square wave twist profile, a very short disturbed twist length at the reversal node and a node strength of at least 50% the strength of the singles yarn.

The forwarding speed should be coordinated with the twisting cycle in order to obtain uniform twist levels. There should preferably be at least one turn of twist between the exit of the twisting means and the bonding means.

The apparatus for bonding the twisted strands of yarn is preferably an ultrasonically energized horn having an energizing surface opposed to the yarn engaging surface of an anvil that is movable into contact with the horn. The anvil yarn engaging surface is configured to arrange the yarns side-by-side in a plane perpendicular to the opposed surfaces of the horn and the anvil.

One or all of the yarns being ply twisted are preferably treated with a plasticizing agent and/or a material to enhance cohesion prior to the bonding operation.

Additionally, the yarn produced during the forward motion may be accumulated to feed forward at a constant rate to, e.g., a windup. The yarn may also be delivered to a continuous heat setting operation using steam or hot air before winding. The plied yarns may also be passed through a single yarn passage of a booster torque jet located after the ultrasonic device, the jet twisting the plied yarn at the same time as the singles and in a direction either the same as or preferably opposite to the singles. A tension transducer may be employed to monitor the instantaneous tension in the plied yarns while in the plying operation and the output may be used as one element of an automatic process control system. Optionally, one or more yarns may be added between the plying yarns preferably as they exit the torque jet.

Alternatively, the individual yarns may be twisted by pressurized fluid in only a single direction, the yarns being twisted simultaneously during one forward motion, the yarns being allowed to ply twist together during the next forward motion by the opposite torque accumulated in the yarns, which may be aided or opposed by the booster jet.

The individual component yarns are preferably substantially equal in denier and the lengths of the component yarns when unplied are substantially equal. Individual component yarns are preferably staple yarn or bulked continuous filament suitable for use in carpets.

The plied yarn preferably has a remaining single strand twist of less than one turn per cm., a ratio of ply twist to singles twist of greater than 0.6 and a node strength of at least 50% of the ultimate filament break strength of a single strand.

Although the product which is preferred for most uses has substantially uniform singles twist and ply twist in each equal section of S or Z twist, novelty yarns having different degrees of twist in portions of the sections which may have varying length may be made by suitable programming of the primary torque jet and/or booster-jet activation or other functions.

While the supply yarns are preferably of crimped continuous filament or crimped staple for carpet use, they may contain minor portions, up to about 10%, of uncrimped fiber or filaments such as conductive material for control of static electricity or to provide some visual styling attribute. Plied yarns of either crimped or uncrimped filaments may also be made for woven or knitted fabrics, cordage and thread.

The supply yarns may range in denier from 1000–3000 denier commonly used for carpets to 250–800 denier suitable for apparel and upholstery. Still lower deniers may be used for thread. The degree of ply twist may vary from the range of 3.0–3.5 turns per inch (1.2–2.2 t.p.cm) conventionally used for carpets to much higher twists used for apparel. Whereas conventional ply twisting is severely limited by the loss in productivity at higher twist levels, the present product is limited mainly by the loss in bulk which usually accompanies high twist. Ply twist levels of 5 tpi (1.8 t.p.cm) or more are easily achieved in the present process using, for example, supply yarns of 1300 denier, with little or no reduction in processing speed, thus greatly extending the range of products which can be made economically.

BRIEF DESCRIPTION OF THE DRAWINGS

FIG. 10 is a flow diagram of a computer program for obtaining the twist distribution according to the invention.

FIGS. 11, 12 and 13 are logic flow diagrams of the control system of this invention.

DETAILED DESCRIPTION OF THE DRAWINGS

Figure 1:
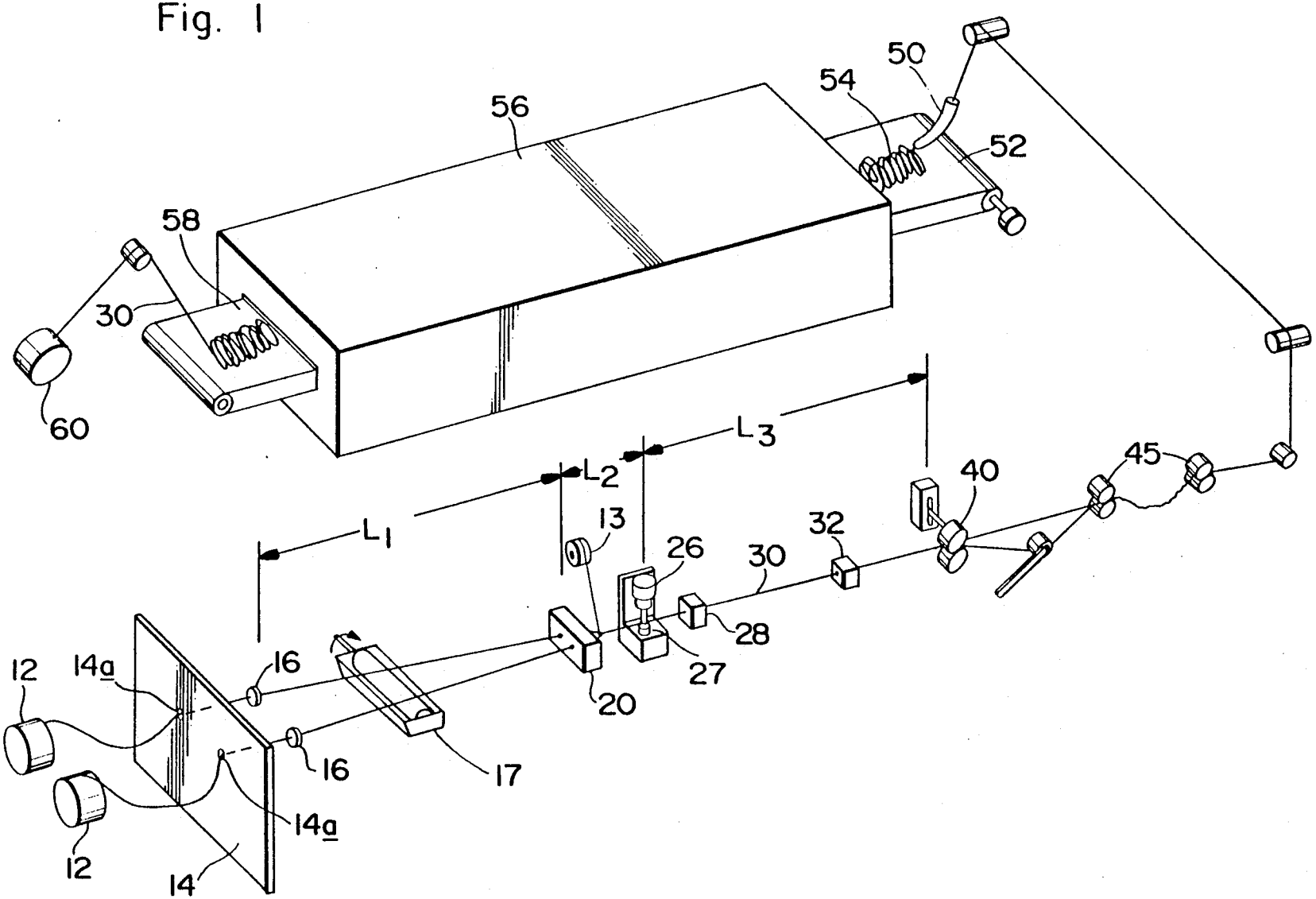
FIGS. 1 and 1A are schematic drawings of the apparatus and associated control features, respectively, used in practicing the process of the invention.

Referring to FIG. 1, crimped carpet multi-filament yarn strands 10 are taken from supply packages 12 through holes 14*a* in baffle board 14 to tensioners 16 over a finish applicator 17 and enter torque jet 20, shown in more detail in FIGS. 2A-2D. Compressed air is admitted to two passages of torque jet 20 by pneumatic valves 22 which are programmed by controller 24*b*. Torque jet 20 twists yarns 10 in alternating directions in the region between tensioners 16 and torque jet 20. The yarns ply twist together as they leave torque jet 20, and periodically they are squeezed and bonded together by ultrasonic horn 26 and associated anvil 27 while their forward motion is stopped. A single booster torque jet 28 which is similar in construction to one half of torque jet 20 is placed after ultrasonic horn 26 to assist the ply twisting in a manner disclosed in British Patent No. 2,022,154 and described more specifically hereinafter. Plied yarns 30 then pass through puller rolls 40 which grip yarns 30 and accelerate and decelerate them in a cycle controlled by controller 24*a*. If desired, a tension transducer 32 to detect instantaneous tension in plied yarns 30 may be placed between booster jet 28 and puller rolls 40, and the output of the transducer may be used to assist automatic or manual control of the cycle. If a yarn, such as an antistatic yarn, is to be added, it may be fed from package 13 through a guide situated between the plying yarns at the exit of torque jet 20.

The distance between the tensioners 16 and the torque jet 20 designated $L_1$ forms a zone, the distance $L_2$ between torque jet 20 and ultrasonic horn 26 forms another zone and the distance $L_3$ between the ultrasonic horn 26 and the take up rolls 40 forms a third zone.

Yarns 30 may then be wound on a package or alternatively may go directly to laydown device 50 which deposits them on travelling belt 52 in a pattern of overlapping or continuous spirals of yarn 54. Belt 52 then carries the spirals of yarn 54 into heating tunnel 56 which heats the yarns to set them in the ply-twisted configuration by saturated steam. At the exit end 58 of the tunnel, yarns 30 are removed from the belt and are wound on package 60. More than one of plied yarn 30 may travel through heating tunnel 56 at the same time.

Since the twisting and node fixing operations are intermittent and subsequent operations are continuous, it is desirable to provide a short-term accumulator before the next constant speed device. The simplest expedient is to provide long free distances between the stop and go motion and the continuous motion elements. Since the alternating twist acts as a spring, the yarn itself will act as an accumulator. Other short-term accumulators could be mechanical dancer rolls or pneumatic systems which provide air cross flow to the yarn between two side plates, thus diverting the yarn during periods of low axial tension and releasing the yarn during high axial tension.

Figure 2B:
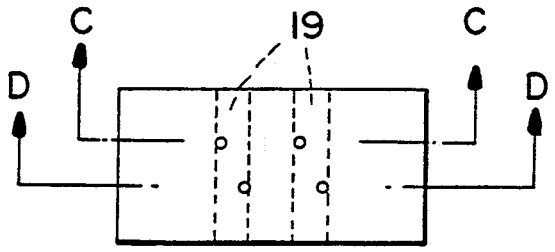
FIGS. 2 A–D are schematic drawings showing a torque jet useful in practicing the invention.
Figure 2D:
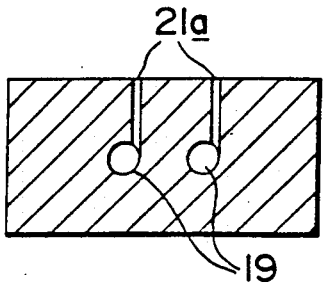
Figure 2A:
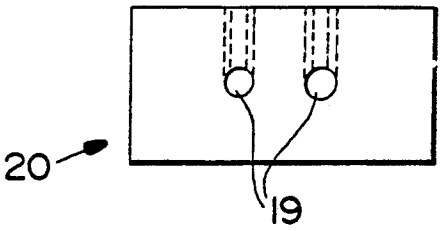
Figure 2C:
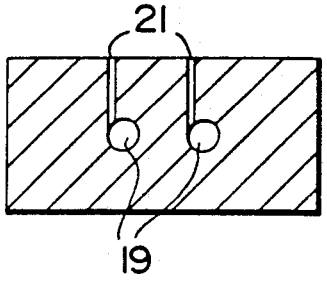

Referring to FIGS. 2A-D, torque jet 20 has two parallel yarn passages 19 as shown in FIG. 2A, each of which is intercepted by two air passages 21 and 21*a* located tangentially to yarn passages 19 but at different locations along the axis as shown in FIG. 2B. Alternatively, yarn passages 19 may converge toward their exit ends. FIGS. 2C and 2D are cross sections of jet 20 taken along lines C—C and D—D, respectively. As compressed air is admitted alternately to air passages 21 or 21*a*, the yarns are twisted first in one direction and then the opposite.

Figure 3:
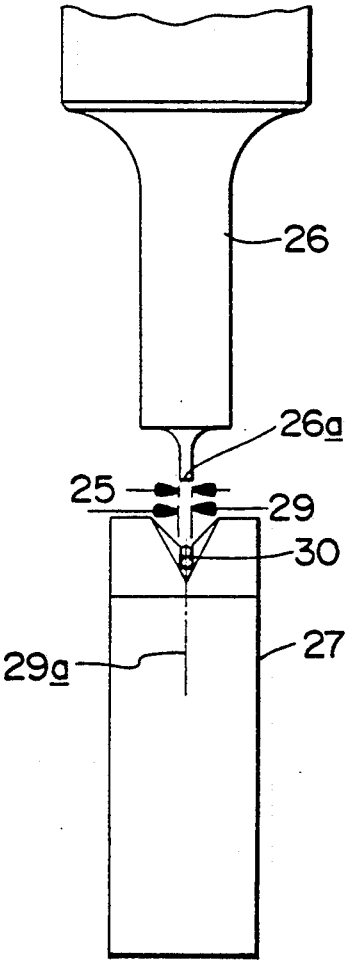
FIG. 3 is a schematic drawing of an ultrasonic horn and anvil for fixing nodes.
Figure 4:
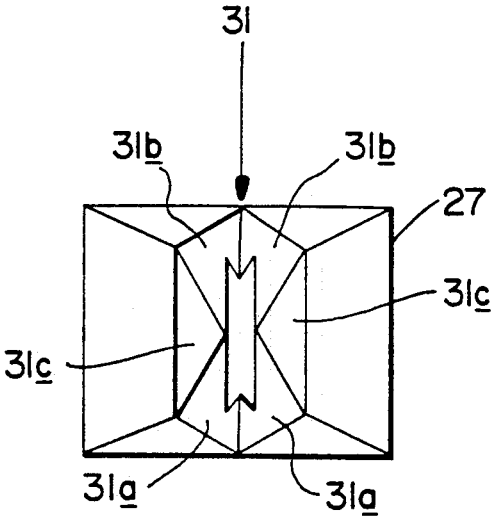
FIG. 4 is a schematic plan view of the anvil of FIG. 3.

FIGS. 3 and 4 show ultrasonic horn 26 and associated anvil of FIG. 1 in more detail, wherein ultrasonic horn 26 mates with anvil 27 when the anvil is moved vertically. A spring (not shown) is placed between anvil 27 and the anvil piston to regulate the pressure. Preferably, the spring has a high spring constant to resist the vibrations of the horn 26. The slot 31 in the surface of the anvil 27 is opposed to the energizing surface 26*a* of the horn 26. The front, back and intermediate surfaces designated 31*a*, 31*b* and 31*c* respectively are angled toward the longitudinal axis of the slot 31. Plied yarn 30 moves into the plane of the drawing and is normally located just below the tip 26*a* of horn 26. When a node is to be fixed, anvil 27 rises and engages the ply twisted yarn 30. The width dimension 29 of slot 31 is made approximately the diameter of one of the plies of the plied yarn so that the plied yarn will fit compactly into slot 31 when the strands lie between the energizing surface of the horn and the surface of the anvil containing the slot 31. The slot 31 is chamfered to force the yarn into a controlled plane 29*a* in the slot as anvil 27 rises and engages yarn 30. As best shown in FIG. 3, the yarn is contained in a channel defined by the horn and the slot. Thus, the plied yarn is contained and squeezed at a twisted section where the strands cross. Anvil 27 continues upward and presses yarn 30 against the tip 26*a* of horn 26 which is continuously energized, heating the plied yarns and forming a thermal bond between them.

Thickness dimension 25 of horn 26 is a close clearance fit with dimension 29 of slot 31. It is preferable that the horn be made of a material which has low acoustic loss and that the clearance between the horn 23 and the slot 31 of the anvil is just slightly more than the diameter of one of the individual filaments of carpet yarn strands 10. Titanium and aluminum are two suitable materials. The portion of the anvil contacting the yarn should be of a material having low heat thermal conductivity, good wear resistance and anti-stick properties. Suitable materials are polyimide resins and certain ceramics. A brass anvil portion has also been found to work well.

The ultrasonic transducer can be either magnetostrictive or piezoelectric, although a piezoelectric transducer is preferred because of its high electrical to vibrational conversion efficiency, which is particularly important because of its continuous operation. Alternately, the ultrasonic horn and transducer can be made an integral unit, to reduce the overall size and provide a more compact bonding assembly.

The vibratory energy supplied by the ultrasonic horn 26 can be in the frequency range 16–100 kHz, but the preferred resonant frequency range is 20–60 kHz, and the best bonding performance has been obtained at about 40 kHz. The vibrational amplitude of the tip of the horn 26 is in the range 0.0015–0.0025 inches (0.038–0.064 millimeters) peak-to-peak. Throughout the operation of this process the electrical power is preferably delivered continuously to the transducer for bonding the ply twisted yarn and is in the range 50–80 watts during bonding, resulting in a power density at the bonding tip in excess of 1500 watts/cm$^2$. This high power density is necessary to produce the very short (<50 msec) bonding times.

The force applying pressure to the yarn between the anvil and the horn is an important parameter for obtaining a good bond. The force is controlled by the spring between the anvil actuator and the anvil. The anvil is moveable axially with respect to the actuator and is forced to the end of this movement by the spring. The actuator is adjusted so that the bottom of the anvil slot just barely clears the end of the horn with no yarn present in the extended position of the actuator. When yarn is present, it displaces the anvil downward relative to the actuator, thereby compressing the spring which exerts a predetermined force. In this way, a large actuating force can be used for high speed anvil movement while the squeezing force is lower as determined by the compressed spring. A squeezing force of about 5–10 pounds has been found to work well. Such a spring and anvil arrangement is disclosed in U.S. Pat. No. 3,184,363 which is hereby incorporated by reference for such disclosure. In operation, the bonding is started and stopped by applying and removing pressure to the yarn strands captured between the horn and the anvil. The horn is continuously energized and its energy is coupled to the yarn only during the time the pressure is applied. Surprisingly, the bond does not require a separate cooling period under pressure before the bond continues through the process and strong bonds result. The tension applied to the yarns during bonding assists in consolidating the filaments, and aids in inserting the plied strands in the anvil slot while maintaining the plied angled orientation of the strands which is essentially maintained during bonding.

Figure 5:
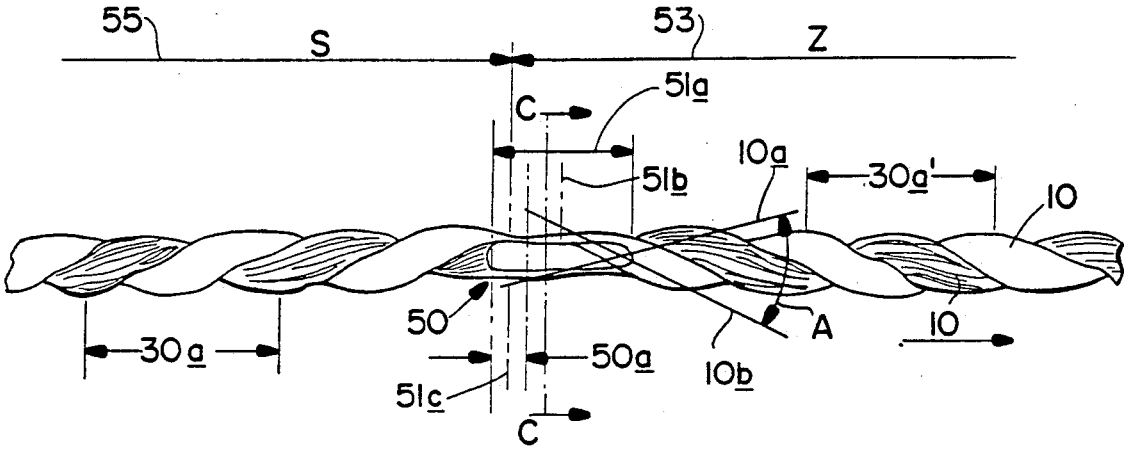
FIG. 5 is an enlarged schematic drawing of a typical fixed node in a yarn of the invention showing the nature of the twist plying on either side of the node.

FIG. 5 is an enlarged schematic drawing of a plied yarn 30 of the invention near a reversal node 50 which has been fixed by the ultrasonic horn 26 and has bond 51 with a length designated 51*a* which is less than the length of one turn of twist, i.e. length 30*a*. The length of the bond 51*a* is also preferably less than 2.0 times the diameter of the plied yarns. Zone 53 to the right of reversal node 50 is ply twisted in one direction (Z twist) and zone 55 to the left of the reversal node is twisted in the opposite direction (S twist). The degree of twist in zone 53 is approximately equal to that in zone 55, and the degree of twist is approximately constant within each of the zones.

As shown in FIG. 5, the center of bond 51 which is designated by line 51*b* and the center of the reversal node 50 which is designated by line 51*c* are not in alignment with each other and the strands 10 are bonded together at an angular relationship to each other as represented by angle A included between lines 10*a* and 10*b* representing longitudinal axes of the strand 10 at that location. The angle A is generally about the same as the angle of the adjacent unbonded ply twisted strands. The position of the twisted strands in the cross section of the bond 51 will depend on the instantaneous relationship of the strands 10 to each other when they are squeezed into the slot 31 in the anvil 27.

Figure 17:
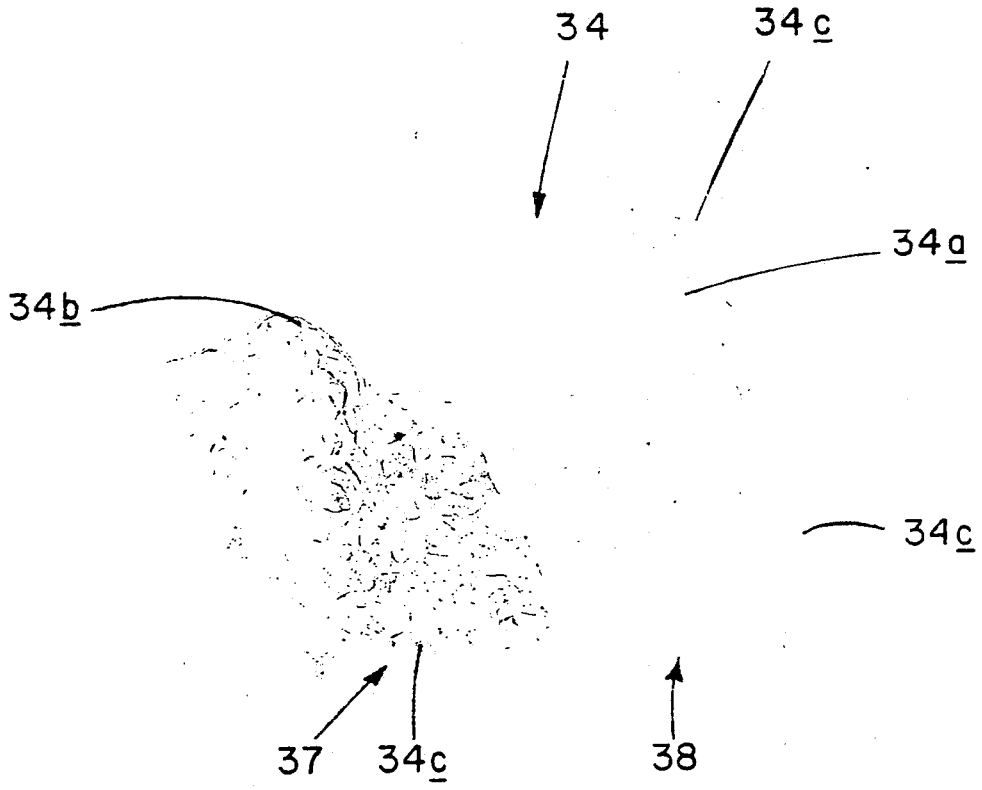
FIG. 17 is an enlarged (100x) photograph of a representative cross section of a bond formed in the alternate twist plied yarn of this invention taken along line c—c of FIG. 5.

The cross-section also may vary along the length of the bond. In the embodiment described, the particular clearance between the anvil and horn is slightly more than the diameter of the individual filaments of a strand. The cross-section of the bond, generally designated 34, made with this clearance has a generally "U" shaped configuration as seen in FIG. 17. This cross-section was taken at a generally central location in the bond such as line C—C in FIG. 5. The legs 34*a*, 34*b* of the "U" include small groups of filaments 34*c* that find their way into the clearance gap between the side of the horn and the sidewalls of the anvil slot. They are generally loosely gathered and are located on the periphery away from the central portion 35 of densely packed filaments. In addition, filaments 34*c* in other portions of the periphery such as at portions 37, 38 of the cross-section are generally loosely gathered and located away from the central portion 35 of densely packed filaments, sometimes separated from it or just barely touching it. This arrangement may be beneficial in disguising the bond area in an end use such as a carpet or fabric. Surprisingly, in carpets made from the yarn of the invention, these bonds are not readily apparent among adjacent tufts and the dye characteristic of the yarn in the bond is substantially unchanged from the unbonded yarn. In some other end use where a more uniform or compact bond area is desired, the clearance between the horn and anvil slot may be reduced so all of the filaments are compacted into the bond and the cross-section would be a rectangular shape. Other shapes are also possible such as the round or oval shapes disclosed in previously mentioned U.S. Pat. No. 3,184,363.

The reversal node 50 has the unusual characteristic of exceptionally short length 50*a*. Since the bond is made in the ply twisted strands before the ply twist is reversed, the first half-cycle of ply twist is locked-in within the bond. When the ply twist is reversed in the second half-cycle of ply twist, it originates at one end of the bond without appreciable untwisting of the first half-cycle that is locked-in. This results in an abrupt angle change in the strands at the reversal node which is radically different from conventional reversal nodes that have a sinusoidal change in strand angle at a reversal. In the product of this invention, the reversal node length is surprisingly shorter than the bond length. The reversal node length 50*a*, that is the length (measured along the twisted yarn centerline) required to change a strand angle from that of one twist direction to another, is on the order of less than one millimeter for a typical carpet yarn of about 1300 denier per strand. This is, alternatively, less than about one twisted strand diameter or the length of about one-quarter turn of twist of the plied yarn.

Figure 6:
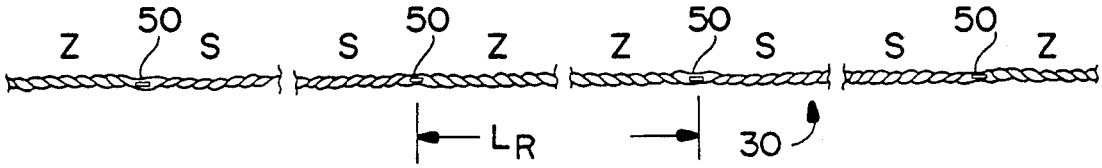
FIG. 6 is a schematic drawing showing several successive sections of reversing twist.

In FIG. 6, successive zones of reversing S and twist are shown. The twist reversal length, $L_R$, is the distance between reversal nodes 50.

Referring again to FIG. 1, as supply yarns 10 are rapidly accelerated and decelerated in accordance with the plying and node fixing cycle, they continue to feed off supply packages 12 by their own momentum while the plied yarns 30 are stopped during node fixing. Baffle board 14 provides a surface against which the yarns can impact and accumulate until the next forward movement occurs, gravity aiding the accumulation.

It is preferred that the holes 14*a* in baffle board 14 be at least about 7 cm apart to prevent tangling of adjacent yarns during yarn stopping and yet be close enough together to minimize any yarn break angle as the yarns converge at the jet 20 which will act as a twist trap. Tangles and tension variations may be further minimized by the use of elongated tubular yarn guides attached to the baffle board between the board and the supply package.

Tension devices 16 regulate the tension on the yarns and also act as twist traps to localize the twist imparted by the torque jets to the regions downstream of the tension devices. They may be of any type but are preferably ones which have good wear resistance, are easy to adjust and maintain uniform tension settings, and minimize the possibility of yarns jumping out of the proper path and/or snagging at the entrance to the tensioners. Finger type tensioners such as Steel Heddle No. 2003 are one suitable type. Preferably, two tensioners may be used in series to provide gradual tension application while avoiding looping or snagging of the yarn. Automatically adjustable tensioners may also be used.

The parallel yarn passages 19 of torque jet 20 as shown in FIGS. 2A–D are preferably sufficiently separated that the component yarns do not tangle with each other as they approach the jet entrances and that the yarns ply freely on the exit side, yet they should not be separated so widely that plying is impeded. Preferably, the center-to-center distances should be no more than about 5 mm at the exit end. Alternatively, the yarn passages may be further apart at their entrance ends. A separator plate may also be employed upstream of the jets to aid in maintaining separation at the jet entrance. The jets are shown in the horizontal orientation, but a vertical orientation works as well.

Certain distances between successive process elements are preferred. The minimum distances are determined by the desired spacing between reversals in the yarn. From a product standpoint, the nodes are less noticeable when they are widely spaced and the yarn appears more uniform when there are long lengths of ply twist in the same direction. The distances between process elements directly affect the twist properties of the yarn between reversals. Referring to FIG. 1, it has been found that length $L_1$, the distance between the tensioner (16) and the torque jet (20), should be a minimum of two times the desired twist reversal length $L_R$ (FIG. 6) in the yarn. The yarn in this distance will twist opposite to the twist exiting the torque jet 20 and, if too short, will significantly impede the development of uniform twist between reversals. The twist stored in $L_1$ is useful in making a rapid twist reversal after a bonded node is formed. The maximum distance of length $L_1$ is determined by the system operability. Longer lengths give more uncontrolled yarn during stoppages for node fixing. A ratio of $L_1/L_R=3$ provides a good balance between twist uniformity and operability.

It has also been found that $L_2$, the distance between the exit of torque jet 20 and the ultrasonic horn 26, should be a maximum of 0.02 times $L_R$. Plying of yarns occurs within $L_2$. This distance affects the twist uniformity in the area immediately adjacent to the twist reversal point (node). If $L_2$ is too long, then the twist surrounding the reversal is normally lower than the remainder of $L_R$ because twist which exists in the yarn between the torque jets and a bonded node must be removed and reversed during the first part of the next twisting cycle. A long distance $L_2$ will include many turns to be removed, and the convergence angle between the two plies will be small, inhibiting the reversal. The minimum distance for $L_2$ is dependent on the physical limitations of the space, the desired twist level and yarn tension, and the yarn separation at the torque jet exit, but should permit at least one turn of twist between anvil 27 and the exit of torque jet 20 for proper gripping of the yarns by the anvil.

It has also been found that $L_3$, the distance between the ultrasonic horn 26 and the takeup rolls 40, should be a minimum of two times the twist reversal length. As the yarns ply together at the exit of the torque jets, the yarn length in $L_3$ provides a low torque as the plied yarn continuously rotates throughout the plying operation. This rotation results in a plied yarn with very little torque liveliness after the takeup rolls 40. The maximum distance for $L_3$ is determined by the ability to rapidly transmit the velocity profile being induced into the yarn at the takeup rolls 40 back to the torque jets 20 and ultrasonic horn 26. It has been found that an approximate ratio of $L_3/L_R=3$ provides a balance of minimizing the yarn twist liveliness and controlling the yarn velocity at the torque jets and bonder.

Another reason for preferring a long distance in the zone defined by $L_3$ is that the alternating ply twist gives the yarn substantial elongation under the acceleration forces, which minimizes the accompanying rise in tension. Since the ply twist is of opposite direction on each side of a reversal, as a section of yarn containing a reversal is tensioned, the fixed node rotates and minimizes tension build-up. The crimp in bulked yarns also adds elongation. This "springiness" also aids in keeping the yarns from becoming slack during deceleration and node fixing. In fact, short-term accumulator 45 shown in FIG. 1 may be eliminated if sufficient distance is provided between puller rolls 40 and the next feeding or winding device.

To assure optimum ply twist uniformity on both sides of a bonded node, it is important that the yarn not slide longitudinally while it is gripped between the anvil and the horn while being bonded. Although the puller rolls 40 are stopped during the bonding portion of the cycle, the inertia of the yarn may tend to keep it moving as the anvil grips it, and before the anvil is in contact with the horn. Such slippage reduces the twist on one side of the anvil and increases it on the other, and is more likely when the average yarn speed is high or when the anvil or horn become worn. Normally, the movement of the anvil will be set to press the yarn against the horn sufficiently hard so that the yarn does not slide while the ultrasonic energy heats the thermoplastic filaments to fuse them together, but should not be so high as to inhibit the vibration of the horn or weaken the yarn at the node.

If the gripping action of the anvil and the pressure against the horn are insufficient to prevent the yarn from sliding, a clamp may be provided to grip the yarn on the upstream or downstream side of the anvil or both, either at the same time as the anvil contacts the yarn or slightly before, the clamp releasing the yarn as the anvil retracts. Such clamp may either be attached to the anvil mechanism or may operate independently.

The drive motor or motors for puller rolls 40 must be capable of very rapid acceleration and deceleration at carefully controlled rates.

Controllers 24a and 24b must be capable of programming all functions.

The Control System

Figure 1A:
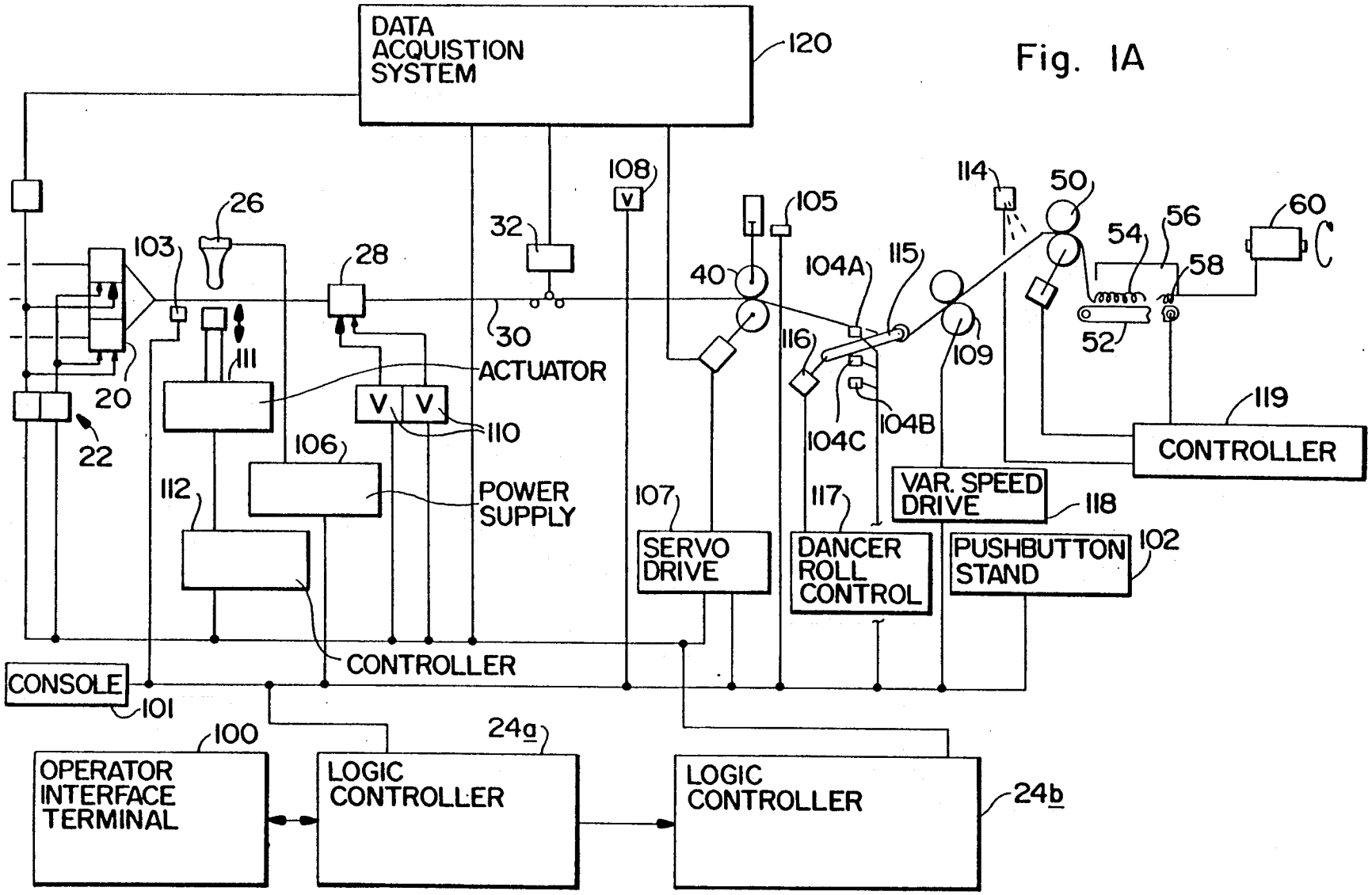

Referring to FIG. 1A the controller is comprised of two commercial programmable logic controllers 24a and 24b. The master PLC, 24a, receives operator interface commands from the operator interface terminal 100, operator pushbuttons on the control console, operator pushbuttons at the nip stand 102, and equipment conditions from misc. position sensing proximity limit switches 103, 104A, 104B, 104C, and 105. The master PLC 24a, effects proper machine control and interlocking, machine starting and stopping, monitors alarm and fault information from the ultrasonics power supply 106 (model P1M15-2.80 DCR 80-331B by Sorensen of Manchester, N.H.) and the servo drive 107 and operates those devices not involved in the high speed cycle such as enabling the ultrasonic power supply 106, the servo drive 107, the open/close solenoid valves 108 for the profiled speed puller rolls 40; and the start/stop of the accumulator puller rolls 109. It also receives the desired operating parameters from the operator interface terminal 100, manipulates these parameters into the proper format and downloads them to a slave PLC 24b, and to the servo drive 107. The slave PLC 24b receives the timing information to operate the electro/pneumatic valves 22 for the primary torque jets 20, the electro/pneumatic valves 110 for the secondary booster torque jets 28, linear actuator 111, which moves the anvil 27 toward and away from the ultrasonic transducer horn 26, and the starting and stopping of the profiled speed puller rolls 40. The parameters downloaded from the master PLC 24a to the servo drive 107 consist of the time, speed, acceleration, and deceleration information which defines the desired cycle speed/time profile of the puller rolls. The slave PLC 24b is operated in a manner to control the timed actuation of the above items with a resolution of one (1) millisecond. The servo drive 107, is capable of very rapid acceleration and deceleration of the puller rolls 40. The linear actuator 111, requires overenergization electrical controls 112 in order to provide very rapid linear movements. These overenergization controls 112, initially apply higher than normal voltage to the integral electro/pneumatic valves in the linear actuator to achieve faster than normal response, then the voltage is reduced to normal to prevent damage to the electro/pneumatic valve. The plied yarn 30 may go directly from puller rolls 109 to a wound package 60 or, alternatively, to a laydown device 50 which deposits them on a travelling belt 52 which carries them through a heating tunnel 56 to the wound package 60. A photosensor 114 detects the amount of yarn 30 in the long-term accumulator 45 and controls this amount by varying the speed of the laydown device 50 at the input of the heat tunnel 56. The heat tunnel/windup controls vary the speed of the travelling belt 52 to follow the speed of the laydown device in a ratio mode. The ratio is operator adjustable for optimizing the laydown density.

Since the yarns 30 exiting the puller rolls 40 are in a pulsing "stop and go" pattern and the subsequent operations are continuous, a short term accumulation method is desirable. A long length free catenary of the plied yarns 30 is one method of providing the short term accumulation. One alternative method is to provide a dancer arm for accumulator 45. When using this accumulator, the process will start only if all other conditions are ready, and the dancer arm 115 is in the down position as detected by proximity switch 104b. When the start command is initiated by a start pushbutton actuation on either the console 101 or the nip stand 102, the long term accumulator puller rolls 109 will start first. This will cause the dancer arm 115 to move upward. When the arm is detected by proximity switch 104c, the Master PLC 24a will sense this and cause the slave PLC 24b to start the twisting, node fixing, and yarn pulling equipment. The angular position of the dancer arm 115 is sensed by a rotary transducer 116 which sends this information through a dancer controller 117 to a variable speed drive 118. The drive 118 regulates the speed of the long term accumulator puller rolls 109 such that the yarn speed into the accumulator 109 is equal to the average yarn speed exiting the profiled speed puller rolls 105 thus keeping the dancer arm 115 operating between but not actuating either the up position proximity switch 104a or the down position proximity switch 104b. If either of these two proximity switches 104a, 104b is actuated, the dancer arm 115 is out of its control range and the process is stopped. Other major malfunctions are a failure of the ultrasonics power supply 106, or a failure in the servo drive 107. In the event of the failure of the ultrasonics power supply 106, the Master PLC will stop the node fixing by turning off the ultrasonics power supply 106, stop the operation of the linear actuator 111 to prevent damage to the anvil 27. In the event of failure of the servo drive for the puller rolls 40, the action taken would depend on the process configuration. A configuration containing a puller roll 40 for each threadline would stop the affected threadline's node fixing in the event of a failure of its puller rolls 40. A configuration containing more than one threadline through puller rolls 40 would stop the twisting and node fixing of all these threadlines in the event of a failure of puller rolls 40. A threadline cutdown device or devices could be activated as a part of stopping a threadline. In a multi-threadline machine, only the threadlines affected by a failure would be stopped, allowing unaffected threadlines to continue production. A data acquisition system 120 is desirable for process development, and adjusting, optimizing and monitoring threadline operating conditions. The data acquisition system 120 records data at a high input speed rate from a variety of sensors and devices located along a threadline. This data is subsequently plotted on paper to show the recorded data vs. time with a resolution of one millisecond increments of time. This resolution allows analysis of operating parameters (actuating timing, air pressures, yarn speed and time profile, ultrasonics power, etc.), and their effect on product quality.

| Generic Name | Model No. | Manufacturer | City | State |
|---|---|---|---|---|
| Servo Motor | JR24M4CH/ FC12T/ B125 | PMI Motion Technologies | Commack | NY |
| Servo | RX150/ | PMI Motion | Commack | NY |

-continued

| Generic Name | Model No. | Manufacturer | City | State |
|---|---|---|---|---|
| Amplifier | 150-40-70 B125 | Technologies | | |
| Choke | CH40-70 | PMI Motion Technologies | Commack | NY |
| Transformer | T180-70 | PMI Motion Technologies | Commack | NY |
| Logic Power Supply | LPS-0503 | Creonics Inc. | Lebanon | NH |
| Motion Control Board | SAM-P004 | Creonics Inc. | Lebanon | NH |

Other elements of the control system are as follows:

| Element No. | Generic Name | Model No. | Manufacturer | City | State |
|---|---|---|---|---|---|
| 16 | Tensioner | | Steel Heddle | Greenville | SC |
| 22 | Pri. Jets Pneumatic Valves | 6241C-421 | Mac. Valve | Wixom | MI |
| 24a | Logic Controller | 1785-LT | Allen-Bradley | Cleveland | OH |
| 24b | Logic Controller | 1772-LP3 | Allen-Bradley | Cleveland | OH |
| 100 | Interface Terminal | 1784-T30C | Allen-Bradley | Cleveland | OH |
| 103 | Limit Switch | | | | |
| 104a | Limit Switch | 650502-400 | Veeder-Root | Hartford | CT |
| 104B | Limit Switch | Tubular Proximity Switch | | | |
| 104C | Limit Switch | | | | |
| 105 | Limit Switch | | | | |
| 108 | NIP Open/Closed Solenoid Valve | 6241C-421 | Mac. Valve | Wixom | MI |
| 110 | Sec. Jets Electro Pneumatic Valves | 6241C-421 | Mac. Valve | Wixom | MI |
| 111 | Foret Linear Actuator | D1484 Modified | Foret Systems | Falmouth | MA |
| 112 | Foret Overenergization Control | L1831 | Foret Systems | Falmouth | MA |
| 116 | Rotary Transducer | R155-VS-[illegible] CCW/12 V. DC Supply | Omnisensor/ Bitronic | Saddlebrook | NJ |
| 117 | Dancer Roll Control | 12 M03-00104 | Reflex | Providence | RI |
| 118 | Variable Speed Drive | EST-130 | Toshiba | Tokyo | JAP |
| 119 | Controller for Wind-up and Heat Tunnel | TVP/B3/MAT | Superba | Mulhouse | FRANCE |

Figure 12A:
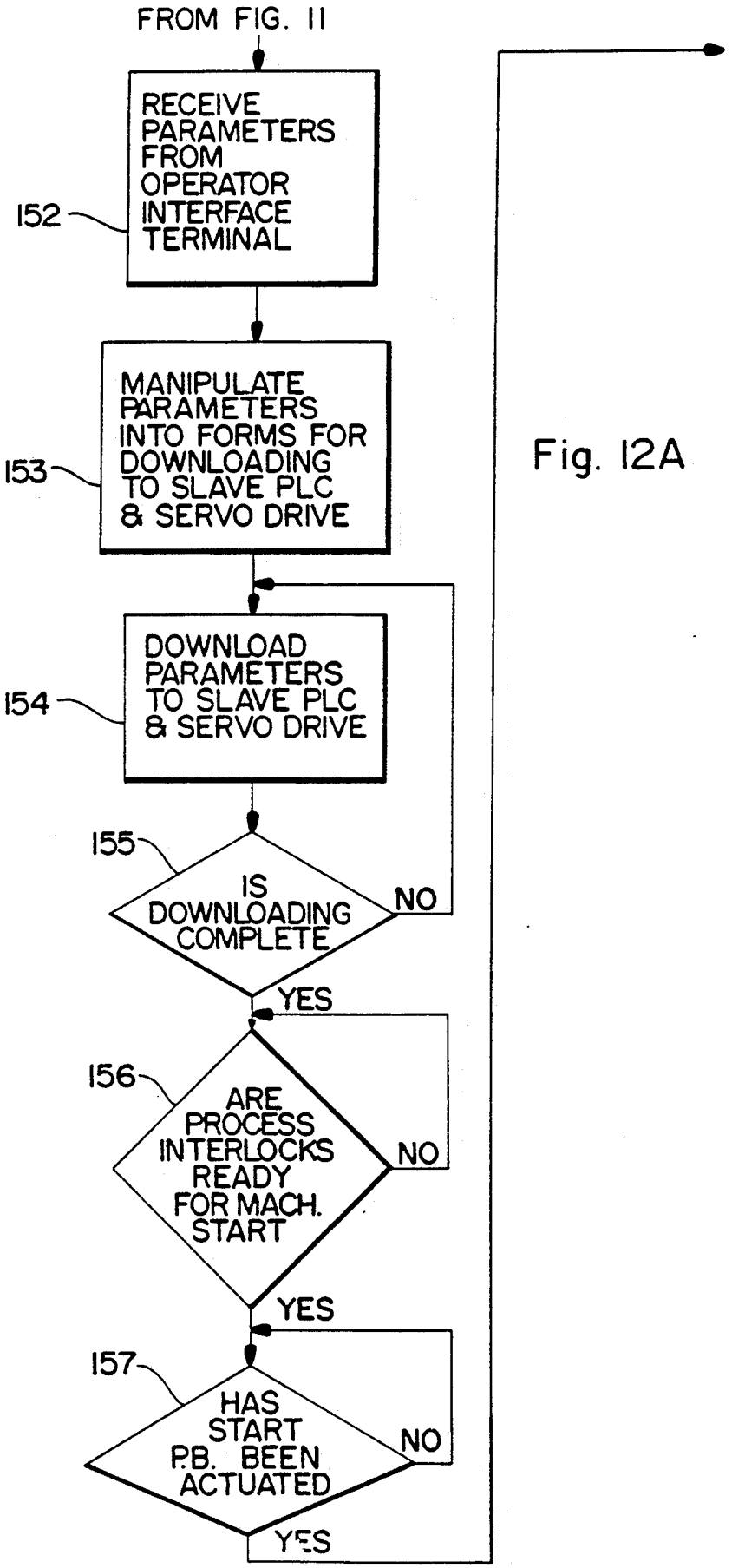
Figure 12B:
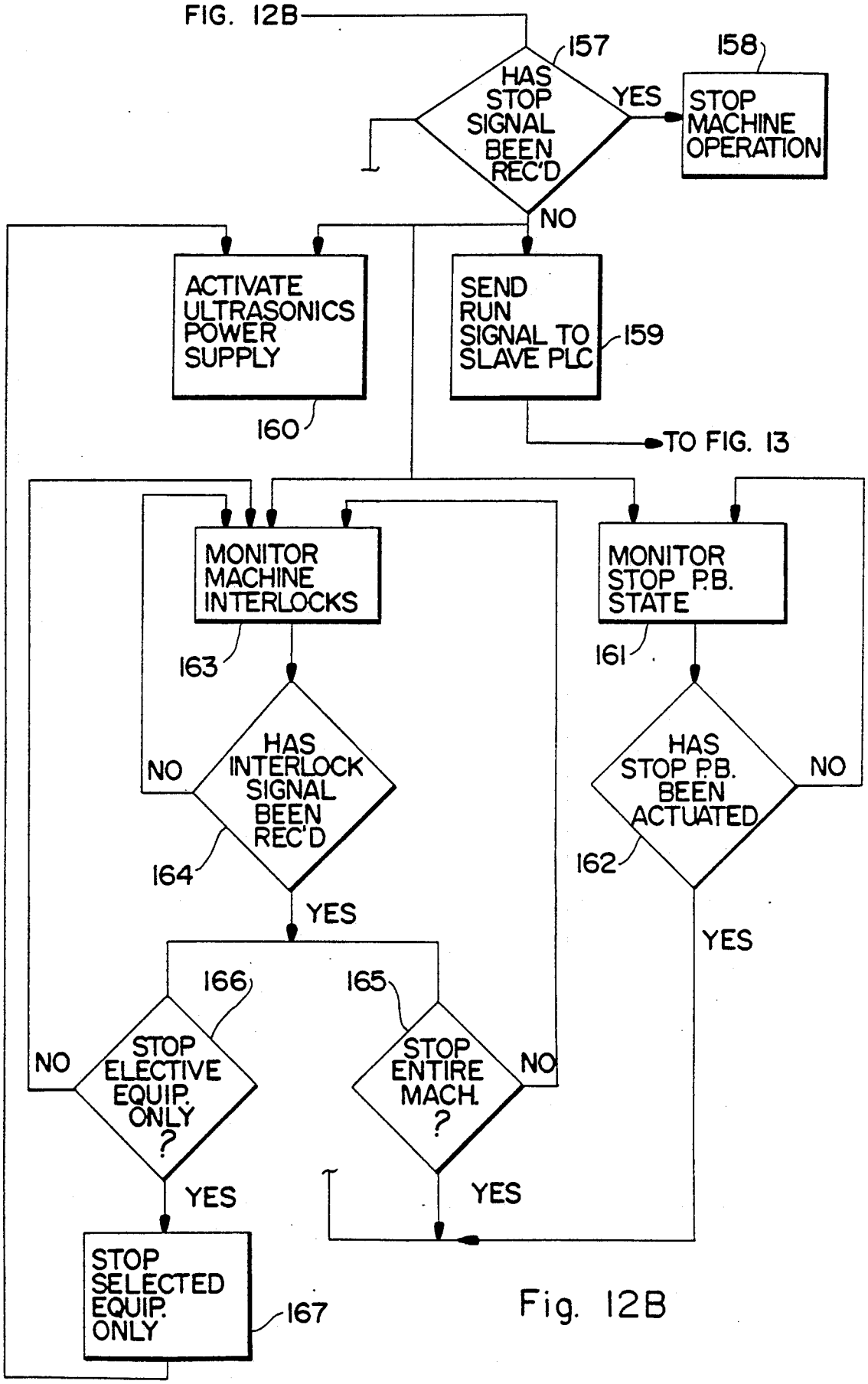

FIGS. 11, 12, and 13 show the general logic for the process. Referring to FIG. 11, the operator interface terminal logic, an operator either enters new operating parameters (actuation timing, puller roll 40 speed vs. time profile, product code, etc.); or selects previously entered and stored parameters via keyboard entry commands 150. When the desired parameters are displayed on the graphics terminal, a keyboard entry 151 will cause these parameters to be transmitted to the master PLC for subsequent downloading to the final controller component. Referring to FIG. 12, the master PLC logic, the desired operating parameters are received from the operator interface terminal (152). When all the parameters have been received, the master PLC mathematically manipulates those parameters to be downloaded to the slave PLC. The puller roll related parameters are mathematically manipulated, inserted into an ASCII file format and then downloaded into the Servo Drive 107. When the downloading is complete (155), and the process interlocks are ready for the machine to start 156 and no stop signal is present (157), the master PLC will send a run signal to the slave PLC (158) when the "Start" PB has been actuated (157). Simultaneous with sending the "run" signal to the slave PLC, the master PLC will activate the ultrasonic power supply(s) readying the ultrasonic transducer for node fixing whenever the anvil 27 presses the yarns 30 against the horn 26. The master PLC will also start monitoring machine interlocks (163), and the stop PB (161). If the Stop PB is actuated (162), a stop signal (157) will cause the machine to stop operating (158). If a machine interlock is received (164), the type of interlock will determine whether to stop the entire machine (165) by means of (157) and (158), or stop selective equipment only (165) and (167). Selectively stopped equipment would include affected node fixing equipment, puller roll(s), and threadline cutters, depending on the equipment being used in a multithreadline machine. On receipt of a run signal from the master PLC the slave PLC will actuate the primary and secondary torque jets, node fixing equipment, a timing pulse to the Data Acquisition System, and the puller roll's accelertion, constant speed, deceleration, and stopping (168). All of these activities are repeated in a cyclic pattern with respect to time as set by the downloading parameters from the operator interface terminal (152). When the run signal is removed from the slave PLC, the cycle will continue until the end of the next node fixing, at which time all activities are stopped. This allows any twisting to be completed and fixed, thus allowing restarting with good product quality.

While it is preferred that contiguous S and Z sections of ply twist be approximately equal in length, the lengths may be varied for novelty product appearances. These products must maintain an over-all balanced twist configuration. Therefore, length variations must be made in pairs such as two long followed by two short, etc., or any combination which balances the overall twist level over some reasonable length of yarn.

Torque jet 20 shown in FIG. 1 is the primary means of twisting the singles component yarns so that they will ply together at a convergence point downstream of the torque jet in the $L_2$ zone. As the production speed increases, the inertia of the yarns becomes greater and the yarns can be over-twisted to the point that the singles twist compacts the yarn bundle excessively and the yarns cannot develop their usual degree of bulk. This problem is particularly noticeable on bulked continuous filament (BCF) yarns which usually have a higher degree of bulk after relaxed treatment in hot water or dye than staple yarns which are usually already compacted by the true twist which is necessary for holding their fibers together and contributing lengthwise tenacity.

In the process of the present invention, careful coordination of the forwarding means (i.e. yarn velocity) and the torque jets (i.e. rotation rate) is necessary to produce uniform ply twist of a desired twist distribution and at the same time avoid excessive singles twist in BCF yarns. The reason for this is that as soon as the singles yarns ply together, they remain in the same position with respect to each other. Thus, ply twist does not equalize along a distance, such as $L_3$, as would singles twist; and ply twist which is formed non-uniformly will remain non-uniform.

The singles twist put into the feed yarns by the torque jet is largely converted to ply twist by the self-plying action, but some singles twist usually remains even when a booster jet is used to assist the twist-plying. The amount of remaining singles twist in a typical carpet yarn is less than one turn per cm, which results in only a small reduction of bulk in the yarns.

Inasmuch as staple yarns already contain a substantial degree of true unidirectional twist, they may behave somewhat differently from BCF yarns in the process of the present invention. For example, when a torque jet applies a twist to a staple yarn, it will tend to become more compact on one side of the jet and to untwist or open up on the other side. Therefore, the cycle control may need to be unbalanced to apply different forces to the yarn in one direction or another. The mode of operation wherein the torque jets twist in only one direction and are off during the reverse part of the cycle may be particularly suitable for staple.

PROCEDURE FOR DESCRIBING TWIST

The basic differential equations describing the alternate ply twisting process are given by:

$$L_1 \frac{dT_1}{dt} + VT_1 = \omega \tag{1-a}$$

$$L_2 \frac{dT_2}{dt} + VT_2 = -\omega + VT_1 \tag{1-b}$$

wherein $T_1$ and $T_2$ are the twist levels in the first and second zones of the twister, respectively, $L_1$ and $L_2$ are the corresponding zone lengths (FIG. 1), t is time, V(t) is the periodic linear process speed variation, and $\omega(t)$ is the periodic rotational twister speed variation (turns/unit time). By employing standard techniques for solving differential equations, it is found that the analytic solution to these equations for long times (periodic steady state) is $$T_1(t) = \frac{\int_0^{t_r} \omega(t-s)\exp\left[-\int_0^{s} V(\xi)d\xi/L_1\right]ds}{L_1[1-\exp(-Vt_r/L_1)]} \tag{2-a}$$

$$T_2(t) = \frac{\int_0^{t_r} [V(t-s)\,T_1(t-s) - \omega(t-s)]\exp\left[-\int_0^{s} V(\xi)d\xi/L_2\right]ds}{L_2[1-\exp(-Vt_r/L_2)]} \tag{2-b}$$

where $t_r$ is the repeat cycle time for the process (i.e. the period of the imposed variations), s and $\xi$ are dummy variables of integration, and V is the average linear velocity over a cycle.

$$V = \frac{1}{t_r}\int_0^{t_r} V(t)dt \tag{3}$$

The length of yarn paid out of the device between the beginning of a cycle and an arbitrary time t through the cycle is given by $$X(t) = \int_0^{t} V(\xi)d\xi \tag{4}$$

A plot of $T_2(t)$ as a function of X(t), with the time t as a parameter, will yield the twist variations along the yarn as a function of spatial position, measured from the exit of the device (This assumes that the twist is locked in at the exit, a condition that is closely approximated in practice.). Note that, if the yarn is assumed to be traveling from left to right, then the twist variations obtained by this procedure must be plotted backwards (i.e. $T_2(t)$ versus $L_r - X(t)$, where $L_r$ is the reversal length, in order to arrive at a correct picture of the directionality for the left-to-right variations of twist.

The above equations can be reduced to dimensionless form by introducing the following dimensionless variables:

$$t^* = t/t_r;\ S^* = S/t_r;\ \xi^* = \xi/t_r;\ V^* = V/V; \tag{5}$$

$$L_1^* = L_1/L_r;\ L_2^* = L_2/L_r;\ \omega^* = \omega/\omega;$$

$$T_1^* = T_1V/\omega;\ T_2^* = T_2V/\omega;\ X^* = X/L_r$$

with $$L_r = Vt_r \tag{6}$$

and $$\omega = \frac{1}{t_r}\int_0^{t_r} |\omega(t)|dt \tag{7}$$

where $L_1^*$ and $L_2^*$ are the ratios of each of the two zone lengths to the reversal length $X^*$ is the dimensionless position along the yarn end, normalized in terms of the length of a repeat cycle, and $T_1^*$ and $T_2^*$ are the dimensionless twist levels in the two zones.

Substitution of Eqns. 5 to 7 into Eqns. 2 yields $$T_1^*(t^*) = \frac{\int_0^1 \omega^*(t^* - s^*)\exp\left[-\int_0^s V^*(\xi^*)d\xi^*/L_1^*\right]ds^*}{L_1^*[1 - \exp(-1/L_1^*)]} \tag{8-a}$$

$$T_2^*(t^*) = \frac{\int_0^1 [V^*(t^* - s^*)\, T_1^*(t - s^*) - \omega^*(t^* - s^*)]\exp\left[-\int_0^{s^*} V^*(\xi^*)d\xi^*/L_2^*\right]ds^*}{L_2^*[1 - \exp(-1/L_2^*)]} \tag{8-b}$$

$$X^*(t^*) = \int_0^{t^*} V^*(\xi^*)d\xi^* \tag{9}$$

Equations 8 and 9 comprise the primary results of the present analysis.

According to this analysis a square wave twist distribution can be approached by coordinating the velocity time function to a rotational function of the strands and the zonal lengths $L_1$, $L_2$ and reversal length $L_R$.

Analysis of the results provided by this formulation show that:

a. Less variations of velocity are needed to obtain a square wave twist if $L_1/L_R >> 1$ and $L_2/L_R << 1$.

b. The velocity time function for square wave twist consists of two important parts. In the region near the reversal, to achieve an abrupt change in twist direction, the yarn velocity must decrease and then increase abruptly. In the remainder of the cycle, the velocity must decrease slightly to prevent the twist from decreasing.

In an actual process, the yarn velocity at the convergence point can be controlled by two machine elements: the squeezing action of the bonder (which provides a means of rapidly changing velocity) and a variable speed roll at the end of zone length $L_3$. The motion of these elements can be used to control the yarn velocity, but allowance must be made for such factors as: yarn slippage, yarn elongation, time delay due to wave propagation delay.

The computer program for predicting this twist distribution is shown in FIG. 10 wherein axial yarn velocity V(t), rotational yarn velocity $\omega(t)$, the length of zone 1 ($L_1$), the length of zone 2 ($L_2$), and the time for reversal of twist from one direction to the other are used as inputs to step 200 in which equations (3), (6) and (7) are solved for average yarn velocity, average absolute rotational yarn velocity and twist reversal length $L_R$. Equation (8-a) is then integrated in step 202 to calculate zone-1 twist-function $T_1(t)$. Equation (8-b) is integrated in step 204 to calculate zone-2 twist-function $T_2(t)$. Equation (9) is then integrated to calculate yarn position function X(t). The above results are combined in step 208 to provide the twist in zone-2 vs. position along yarn and the ratio of zone length to twist reversal length.

COMPUTER PROGRAM

A computer program has been written to perform the numerical integrations required in Eqns. 8*a*, 8*b* and 9 to calculate the twist levels and payout lengths over each cycle, for arbitrary imposed cyclic variations of linear process speed and rotational velocity. The numerical procedures employed in the program are shown in the flow diagram of FIG. 10. Test results generally agree with the computer program predictions.

TEST METHODS

REVERSAL LENGTH AND PLY TWIST DISTRIBUTION—ALONG SAMPLE

Figure 7:
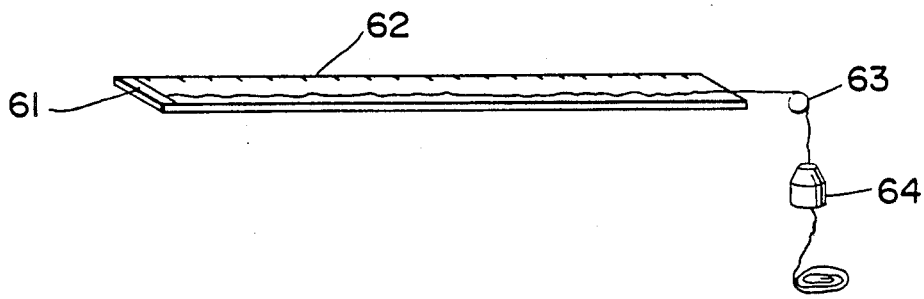
FIG. 7 is a schematic drawing showing equipment for measuring ply twist uniformity along sample.

Ply twist distribution along the length of a yarn sample between reversal nodes is measured using the equipment shown in FIG. 7. A sample of yarn longer than the distance between three twist reversals is unwound from a package and cut, the end which comes off the package first being identified. This end is placed in clamp 61 at one end of meter scale 62, the center of the twist reversal being placed at the zero mark. The yarn is then placed along the length of scale 62 (graduated in centimeters) and over roller 63. Weight 64 sufficient to straighten the yarn but not change the twist is attached to the sample below the roller, excess sample length being allowed to rest below. The number of turns in each 5 cm section are counted, converted to turns per cm, and recorded for the complete section of twist from the clamped end to the next reversal, and from that point through a section of opposite twist to the following reversal. Sections longer than one meter are marked and moved to the clamp end. Distances between reversals are recorded.

Figure 14A:
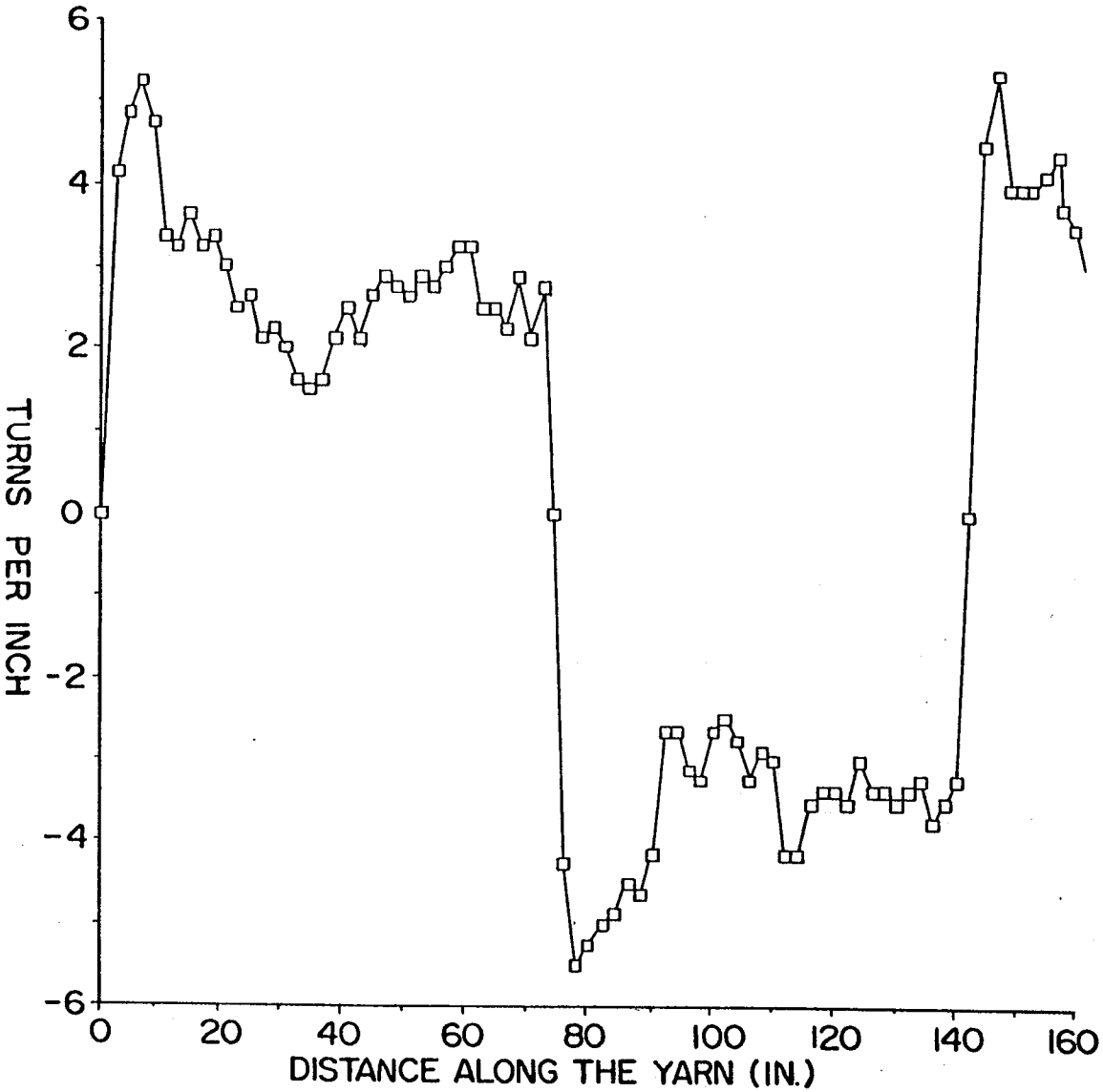
FIGS. 14A, 14B and 14C are graphs which show different degrees of twist uniformity in yarns of Example 1.
Figure 14B:
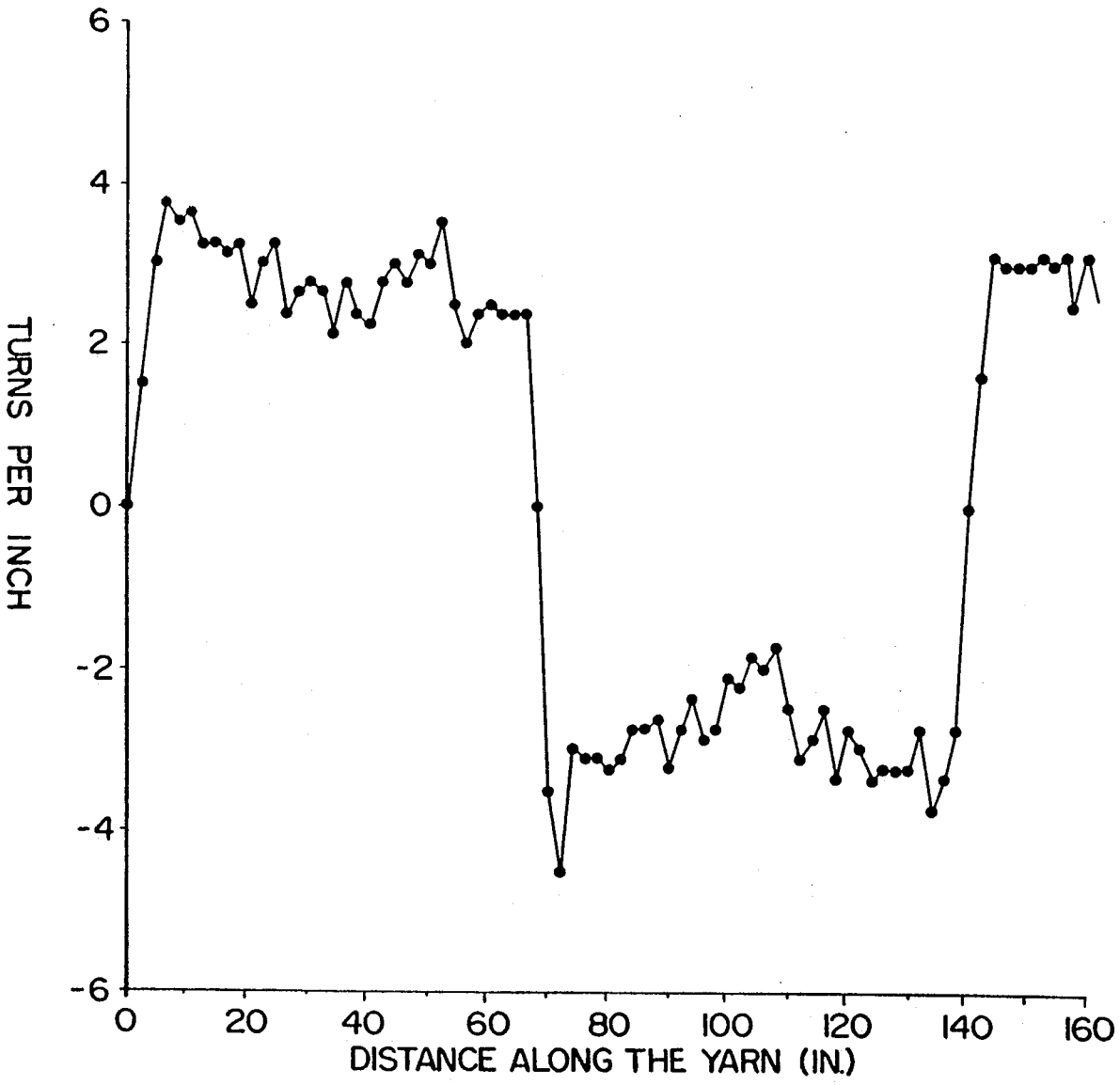
Figure 14C:
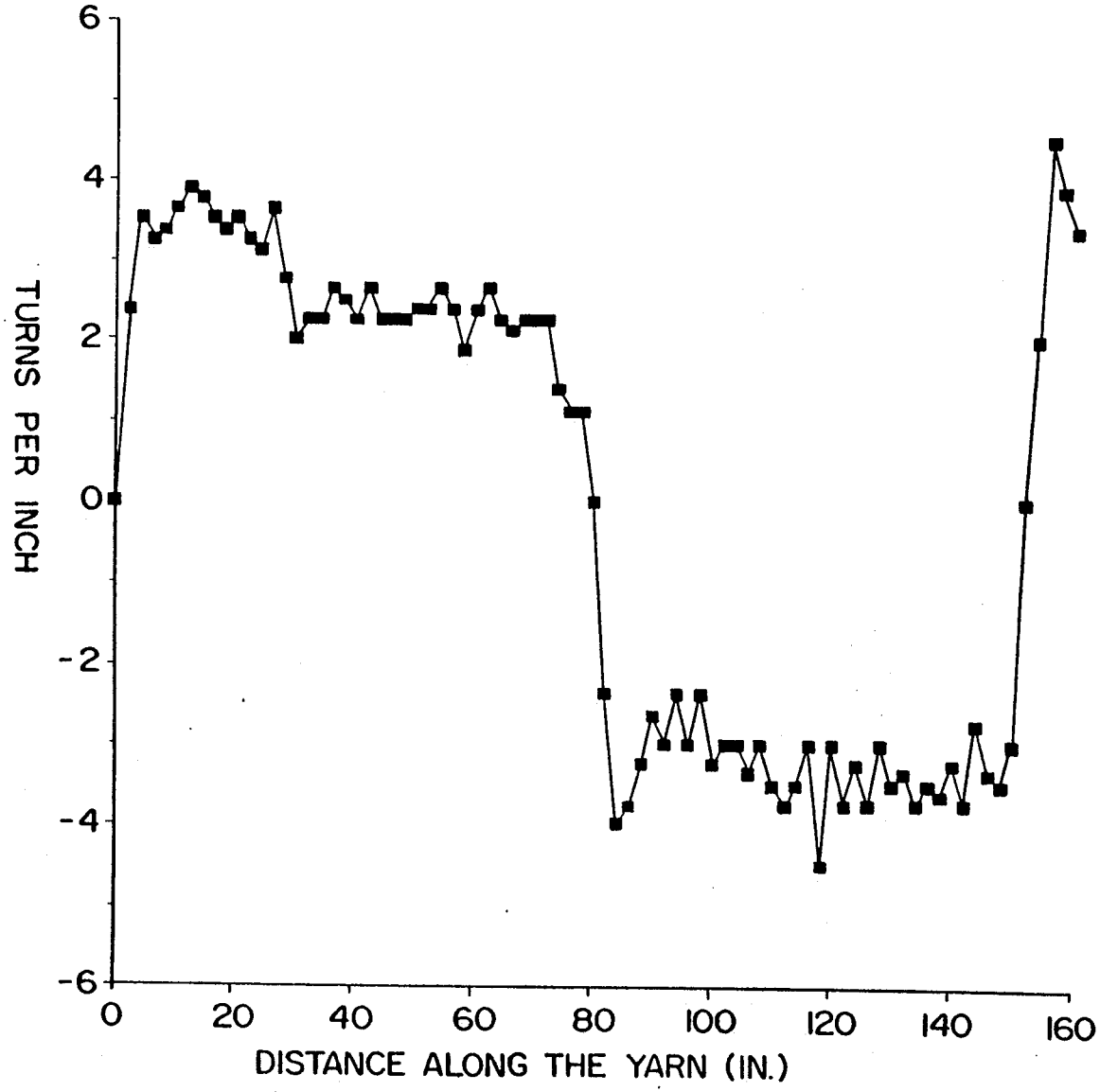
Figure 15A:
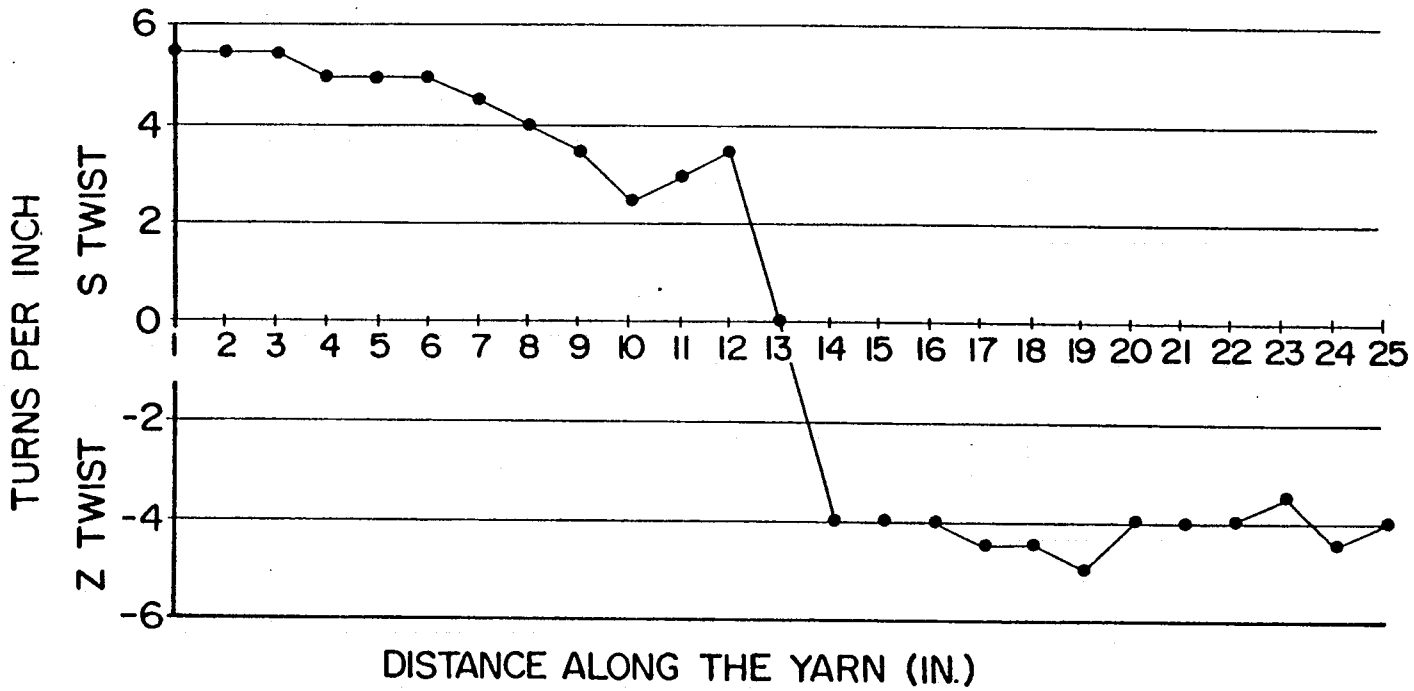
FIGS. 15A and 15B are graphs which show twist in yarns of Example 2.
Figure 15B:
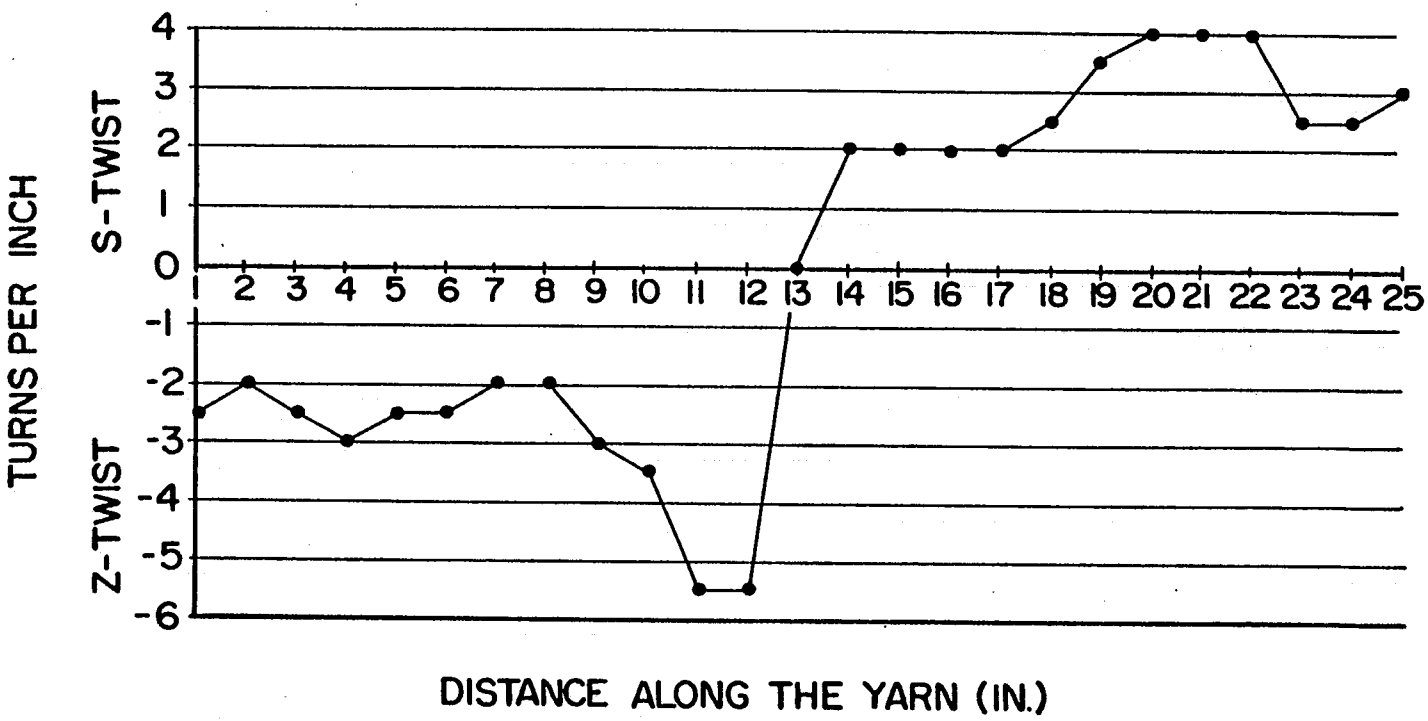

Near a reversal node where there may be less than 5 cm of yarn remaining, the average of the turns in this shorter distance is used. These recorded values are then plotted as in FIGS. 14, 15 and 16. This allows one to visually evaluate uniformity of twist distribution in the "S" and "Z" increments of yarn between reversal nodes. When the twist is measured and plotted in this manner, the square wave shape of the yarn twist distribution of the invention is apparent.

TWIST DISTRIBUTION—CLOSE TO REVERSAL

For studying the twist distribution around the reversal point (±15 cm), it is necessary to record the ply twist every centimeter of yarn length and convert to turns per cm. The same setup is used as described in the "Reversal Length and Ply Twist Distribution—Along Sample" test method.

AVERAGE TWIST—SAMPLE TO SAMPLE

In the yarn twist industry, a measure of twist variations over a long time or production run are often obtained by taking samples from one or more packages and calculating an average twist level. This is useful for determining if long term twist variations are taking place, but it is not useful for determining twist distribution between reversal nodes.

Figure 8:
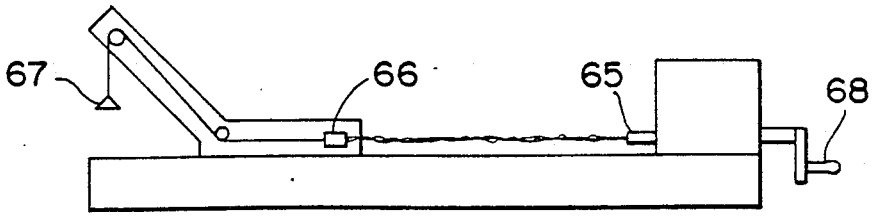
FIG. 8 is a schematic drawing showing a twist counter used for measuring average twist.

When a measurement of average twist is desired, a sample of yarn between nodes substantially longer than 25 cm is cut and one end is placed in rotatable clamp 65 of a Precision Twist Tester manufactured by the Alfred Suter Co., Inc., Orangeburg, N.Y., U.S.A., shown in FIG. 8. Clamp 66 is attached to the other end of the sample 25.4 cm from clamp 65. Clamp 66 is tensioned by weight 67 of 20 gms and is free to slide axially while being restrained from twisting. Crank 68 is then turned in a direction to unwrap the ply twist until all of the twist is removed. The number of turns required to reach this condition is registered on a counter and is recorded.

The ATP yarn process of the invention should produce low average twist variations since it is a precisely controlled process utilizing simple apparatus elements with no rapidly wearing parts.

RESIDUAL TWIST

The twist liveliness of the plied yarn is determined by:

1. Stopping the process to capture a length of plied yarn in the $L_3$ zone.
2. Measuring a 48 inch length of plied yarn in $L_3$, clamp each end so the plied yarn cannot rotate relative to each other, and removing from the remainder of the yarn.
3. Hanging one end from a fixed point and placing a 20 gm weight on the opposite end while preventing any relative rotation end to end.
4. Allowing the free-weighted end to rotate and count the rotations—this is an indication of the stored torsional energy in the plied yarn. A large number of rotations indicates a large residual twist which is generally undesirable.

In Example 3, five tests were conducted for each $L_3/L_R$ ratio and the average of all five tests were calculated.

TENSILE STRENGTH OF YARN CONTAINING BOND

A yarn sample containing an ultrasonic bond is cut several inches away from the bond on both sides. Both plies of one end are clamped in one jaw of a tensile test machine and both plies of the other and in the other jaw. As the sample is extended, the bonded node rotates, and at some load which is usually less than the breaking strength of the yarn, the yarn strands elongate and the bond between the two yarns separates, which can be seen as a sudden drop in the plot of load vs. extension. The sample is pulled at a rate of twenty (20) inches per minute and the force at bond separation is determined. The tenacity of a single strand of the plied yarn which does not contain a bond is tested to break, and the breaking strength of the bond as a percent of the breaking strength of the plied yarn and the single strand is calculated.

MACHINE CYCLE

Figure 9:
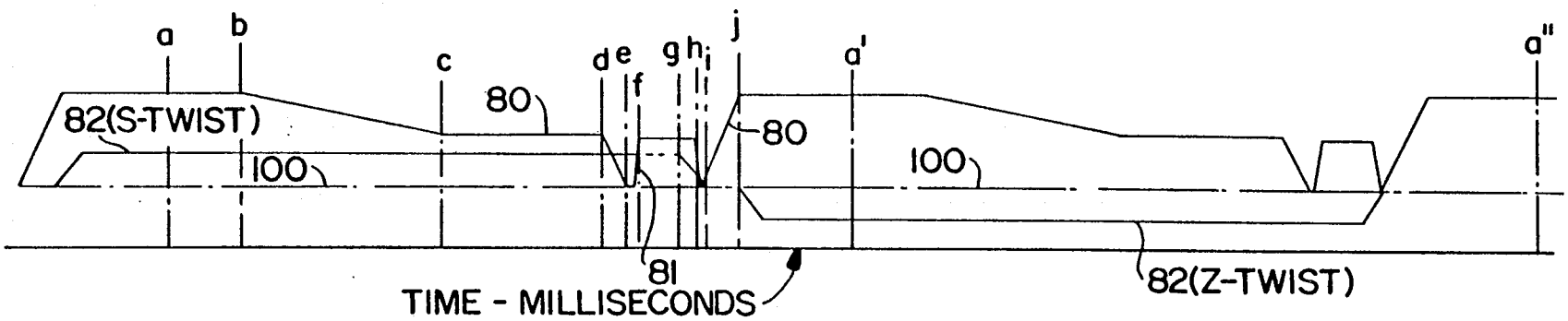
FIGS. 9 and 9*a* are timing diagrams for the process of the invention showing a complete cycle and an enlarged one-half cycle, respectively.
Figure 9A:
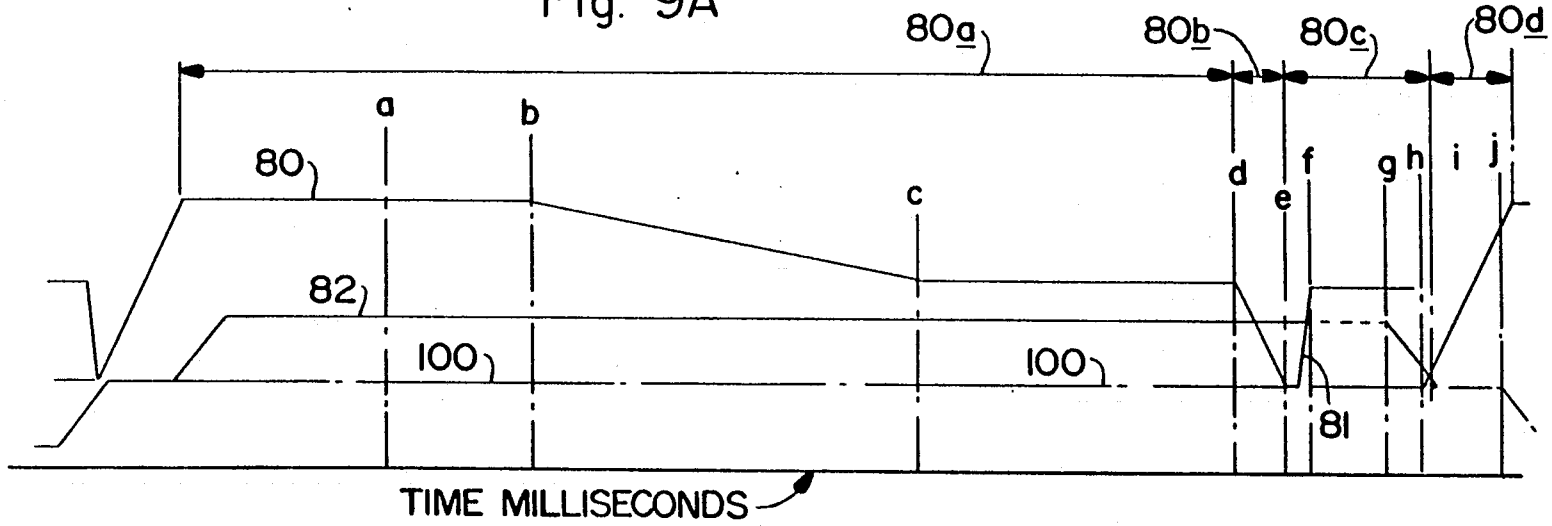

The operation and timing of the machine elements to carry out a typical cycle of operation are shown in FIGS. 9, 9A wherein line 80 shows the plot of pull roll 40 peripheral speed versus time. The vertical axis shows roll speed in yards per minute. This curve is divided into several portions to better understand the important features of puller roll 40 control. The portions are roll advancing 80*a*, roll stopping 80*b*, roll stop dwell 80*c*, and roll starting 80*d*. Since the rolls are frictionally engaged with the yarn at all times, the yarn at the rolls is advanced by the rolls during all portions of the cycle except roll stop dwell. The advance of the yarn upstream of the rolls roughly corresponds to the motion of the rolls with some displacement in time due to elastic oscillations of the yarn and interaction with other machine elements.

Line 82, at an arbitrary level above the horizontal axis 100, is a plot of singles strand twist direction and relative speed versus time produced by the torque jet 20. There are no units of twist speed for the vertical axis. Above the axis represents "S" twist and below the axis represents "Z" twist of the singles strands. Where the plot is coincident with the horizontal axis, the torque jet 20 is off. This plot also represents the operation of the booster torque jet 28 which is actuated at the same time as the twist jets. The system may be operated without the booster jet, but generally it produces a measurable improvement in the ply twist level and uniformity. Sloping of the plots toward and away from the axis occurs since there is a delay in venting and building up pressure in the torque jets. Such delay is generally about 15 ms with the described embodiment.

Line 81, at an arbitrary level above the horizontal axis 100, is a plot of position of the squeezing and bonding anvil versus time with the upper horizontal level representing the fully extended squeezing position and the level at the horizontal axis representing the retracted releasing position. The sloping sides of the plot represent the delay in moving the anvil from one position to the other. Such delay is generally about 6 ms with the rapid response air actuator employed in the described embodiment. At a position within a couple of milliseconds of the extended level, it is assumed the strands are squeezed together and stopped for bonding. Monitoring of the ultrasonic energy that increases rapidly as the yarn is squeezed and bonded confirmed this. It is important that there is no relative motion between the yarn and the bonder during bonding.

Four important features of the invention are illustrated in FIGS. 9, 9A. The first is the relationship between the roll stop dwell 80*c* and the extended squeeze position of the bonding anvil. The pull rolls are preferably stopped during the time the anvil is extended bonding the strands together. This is important since the strands are softened during bonding and if the rolls were advancing the strands a significant distance at the same time, tension would increase and the softened bond would be weakened at best and the softened strands at the bond would break at worst. There is some leeway, however, in whether complete stopping occurs. If the rolls slow to such an extent that one end of the yarn is extended only a short distance (less than ½%) while the other end is stopped, then excess tension is avoided and complete stopping is not required. Operation under these conditions may slightly decrease the reliability of the bond, but at the benefit of increased average line speed. For certain conditions and products this may be preferred.

The second important feature is the relationship between the twist starting and the roll starting 80*d*. Preferably, the roll starting should be nearly complete before the twist starting is begun. When the anvil is retracted and the strands are released, the twister is off so the opposite twist upstream of the twister in zone $L_1$, which is the next twist required, propagates up to the bonded node to form the desired level of twist right next to the upstream side of the node. If the twister is then turned on before the node starts moving away from the twister, the twist right at the node may be excessive and tight snarls may occur which remain in the plied strands thereby creating an unacceptable product.

A third important feature is the relationship between twist stopping and yarn squeezing. Twisting preferably continues until after the anvil has extended and stopped the strands. This forms the desired level of twist right next to the upstream side of the node. If the twister is stopped before the yarn is squeezed to a stop, the opposite twist upstream of the twister propagates through the twister and creates a ply twist reversal that moves downstream of the yarn squeezer and bonder. The bond is then formed upstream of this reversal. This unbonded reversal is unstable and easily untwists leaving a length of yarn without ply twist which is generally undesirable.

A fourth important feature is the decreasing roll advancing rate during roll advancing 80*a* before roll stopping. During roll starting, the rolls rapidly accelerate to the maximum advancing rate. Before roll stopping, this maximum rate is decreased progressively or in steps which has been found to eliminate a decrease in the level of ply twisting that occurs on the downstream side of the node with most strands twisted by the process. This produces a measurable improvement in the average twist level and uniformity of the ATP product.

The total half-cycle time in FIGS. 9 and 9A from, say, a to a', is about 413 milliseconds for the first ply twist direction. For the second half-cycle time of 413 ms, as from a' to a'', the timing of the elements remains the same except the opposite twist jet valve is actuated for the alternate ply twist direction.

In FIG. 9, at some arbitrarily chosen time "a":
the advancing rolls have a peripheral speed of 280 YPM;
the "S" twist jet line is pressurized at 80 psig thereby "S" plying the yarn;
the "Z" twist jet line is unpressurized.
At time "b":
the advancing rolls begin gradually slowing;
the "S" and "Z" jets remain as at "a".
At time "c":
the advancing rolls reach a speed of 160 YPM;
the "S" and "Z" jets remain as at "a".
At time "d":
the advancing rolls begin rapidly slowing;
the "S" and "Z" jets remain as at "a".
At time "e":
the advancing rolls have stopped;
the "S" and "Z" jets remain as at "a".
At time "f":
the anvil has extended toward the horn, squeezed the plied yarn to stop it at the bonder, and bonding energy is going into the yarn;
the "S" and "Z" jets remain as at "a";
the advancing rolls are stopped.
At time "g":
the anvil is still extended, the yarn is stopped at the bonder and bonding energy is going into the yarn;
the pressure to the "S" jet has been turned off and is bleeding down;
the "Z" twist jet line is unpressurized;
the advancing rolls are stopped.
At time "h":
the anvil has retracted enough to release the yarn and stop bonding;
the "S" and "Z" jet lines are essentially unpressurized thereby letting the "Z" twist upstream of the "S" jet propagate downstream to the bond forming a "Z" singles twist and "S" ply twist upstream of the bond;
the advancing rolls are stopped.
At time "i":
the advancing rolls begin rapidly speeding up;
the anvil is nearly retracted;
the "S" and "Z" jet lines are essentially unpressurized thereby letting the stored "Z" singles twist upstream of the jets "Z" twist the singles strands and "S" ply the yarn.
At time "j":
the advancing rolls are still speeding up at a rapid rate;
the pressure in the "Z" jet line is building up toward a pressure of 80 psig to "S" ply the yarn;
the "S" jet line is unpressurized.
At time "a'":
the advancing rolls have a peripheral speed of 280 YPM;
the "Z" twist jet line is pressurized at 80 psig thereby "S" plying the yarn;
the "S" twist jet line is unpressurized;
the first half-cycle repeats between a' and a'' except the opposite jets are actuated.

EXAMPLES

For the following examples, two bulked continuous filament nylon carpet yarns of 1330 denier and 68 filaments were used as feed yarn from packages 12 of FIG. 1.

EXAMPLE 1

This Example shows the effect of various $L_1$ machine distances on the uniformity of twist distribution. Using the test conditions generally similar to those shown in FIG. 9 except roll advancing 80*a* is constant, three different $L_1/L_R$ ratios were tested:

$L_1/L_R=1.04$ (FIG. 14A)

$L_1/L_R=2.13$ (FIG. 14B)

$L_1/L_R=2.96$ (FIG. 14C)

The test was repeated at puller roll velocity equal to 76.2, 91.4 and 152 mpm. In all cases, the $L_1$ trends are the same as shown in Example 1. The conclusion from this testing is that $L_1/L_R>2$ is desirable for twist uniformity—but not sufficient.

$L_2=12.7$ cm $L_3=9.14$ m

EXAMPLE 2

This Example shows the effect of various $L_2$ machine distances on the short-term twist level and uniformity (15.2 cm around the reversal point). Again using the timing conditions similar to Example 1, two different $L_2/L_R$ ratios were tested:

$L_2/L_R=0.0064$ (FIG. 15A)

$L_2/L_R=0.0105$ (FIG. 15B)

For this Example, $L_1$ was fixed at 4.6 m and $L_3$ was fixed at 9.14 m. Again, this comparison was made at puller roll velocities of 74.2, 91.4 and 152 mpm with comparable results. The conclusion is that $L_2$ does affect the twist level around the reversal point and that a small $L_2/L_R$ is preferred.

Twist distribution measurements were done using the "close to reversal" method previously described.

EXAMPLE 3

This Example shows the effect of various $L_3$ machine distances on the final twist liveliness of the plied yarn. Again using the timing conditions similar to Example 1, three different $L_3/L_R$ ratios were tested. $L_R = 108''$

| Test No. | Residual Twist No. of Turns | Avg. | $L_3/L_R$ |
|---|---|---|---|
| 1 | 39 | | |
| 2 | 32 | | |
| 3 | 35 | 36 | 1 |
| 4 | 39 | | |
| 5 | 35 | | |
| 6 | 9 | | |
| 7 | 11 | | |
| 8 | 11 | 10.2 | 2 |
| 9 | 7 | | |
| 10 | 13 | | |
| 11 | 3 | | |
| 12 | 5 | | |
| 13 | 2 | 3 | 3 |
| 14 | 2 | | |
| 15 | 3 | | |

EXAMPLE 4

This Example shows the ultrasonic bond strength of the plied yarn bond adjacent the reversal node. The timing conditions similar to Example 1 were used to produce these samples—$L_1$ was set to 4.6 m, $L_2 = 1.27$ cm and $L_3 = 9.14$. The test method used to determine the bond strength is described above.

| Yarn | Bond Strength | Ultimate Single Strand Break Strength | Control Ply Yarn Strength |
|---|---|---|---|
| 1 | 2.27 kg | 4.08 kg - (56%) | 9.3 kg - (24%) |
| 2 | 2.49 | 3.4 - (73%) | 9.3 - (27%) |
| 3 | 2.72 | 3.85 - (70%) | 9.3 - (29%) |

In operation, the bond must withstand all tensions in the process at least through the heat setting phase where a memory is imparted to the yarn. The maximum process tension is 140 gms.

EXAMPLE 5

This Example shows the effect of changing the linear yarn velocity profile during roll advancing 80*a* while maintaining constant machine lengths. Timing conditions similar to FIG. 9 are maintained while the different puller roll velocity profiles are demonstrated. The machine lengths are:

$L_1 = 15$ ft. (4.6 m)

$L_2 = 0.5$ in. (1.27 cm)

$L_3 = 30$ ft. (9.14 cm)

Figure 16A:
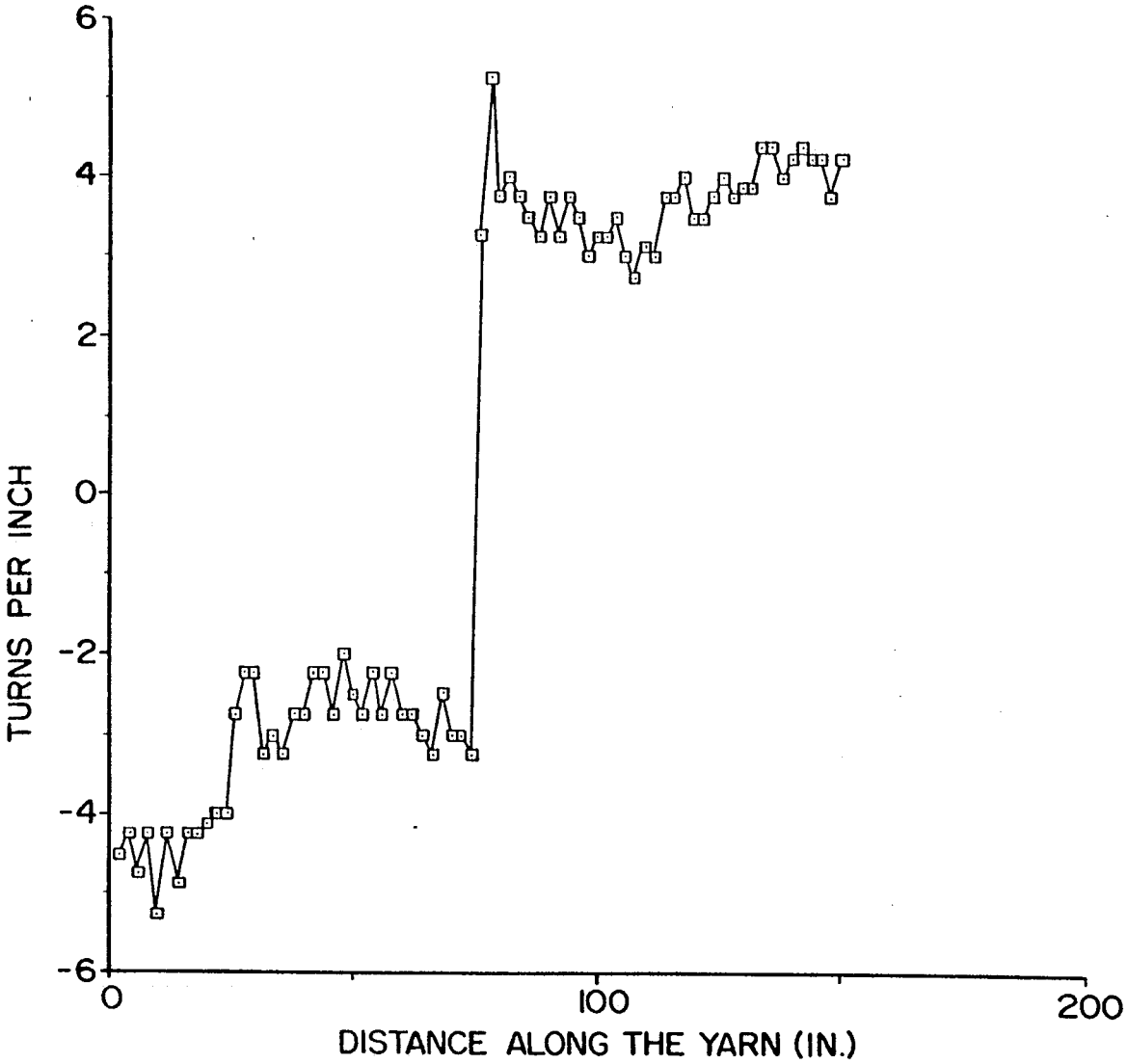
FIGS. 16A, 16B and 16C are graphs which show the results of Example 5.
Figure 16B:
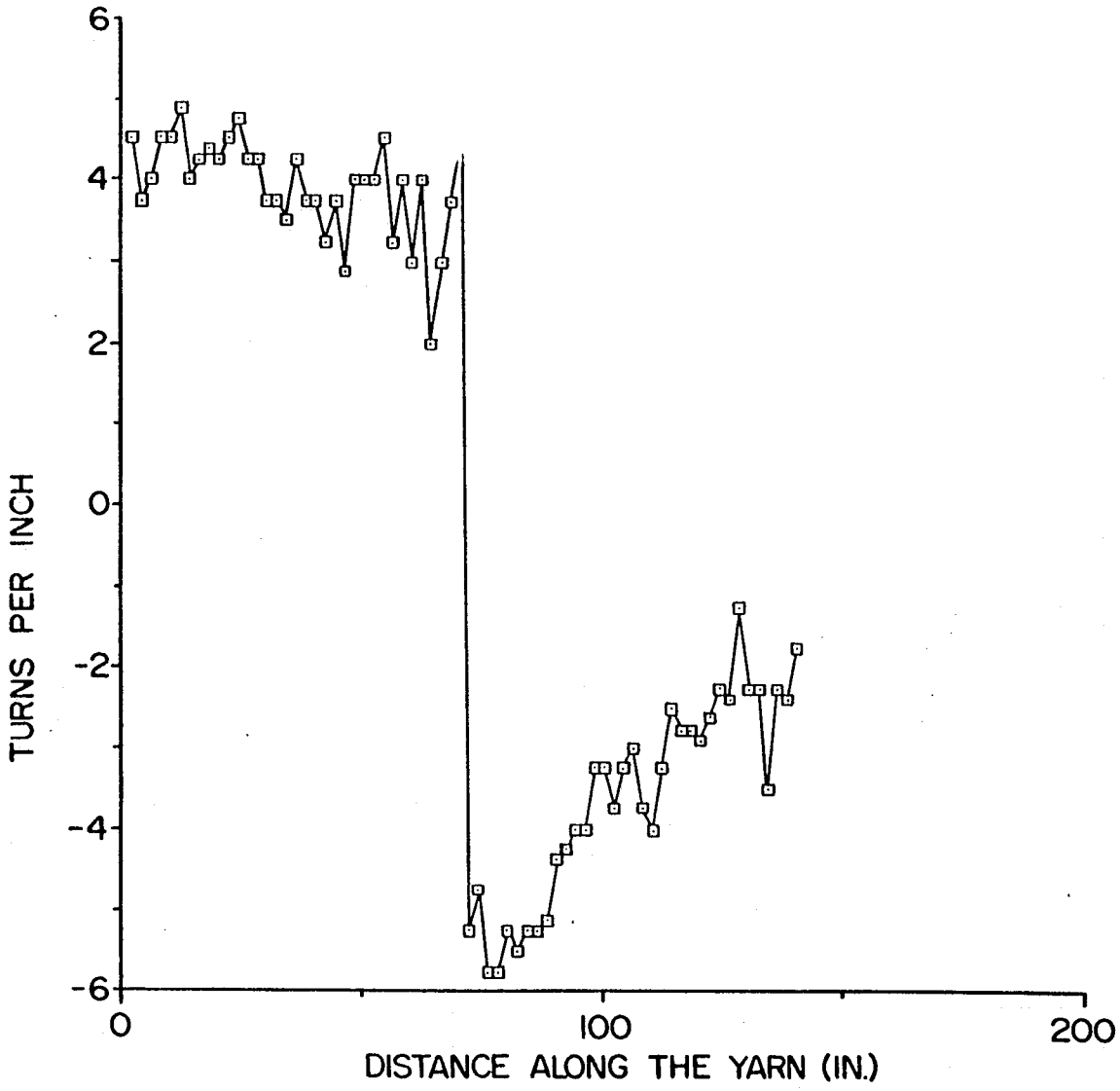
Figure 16C:
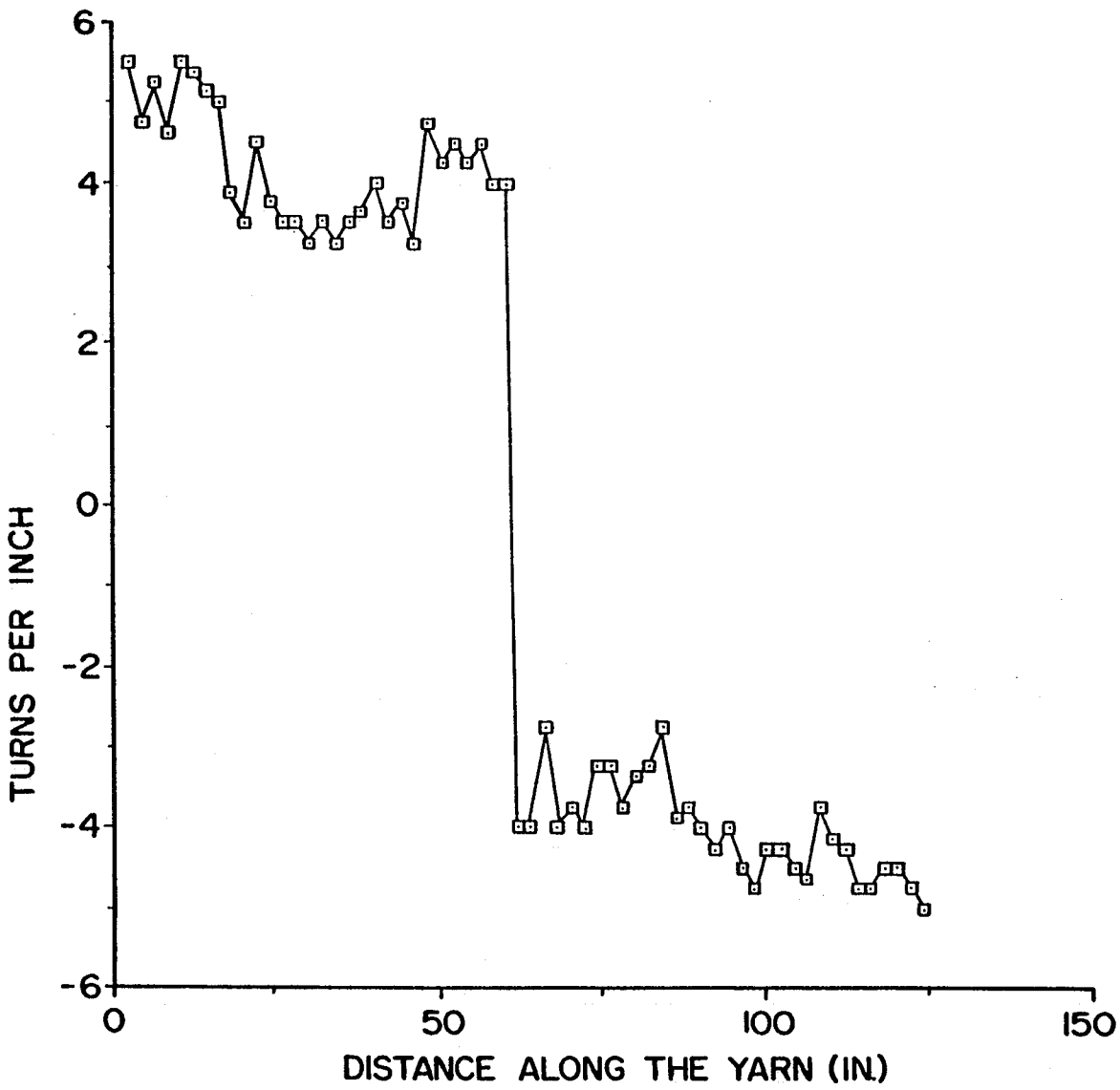

In FIG. 16A, the yarn velocity is accelerated to a constant velocity as described in FIG. 9 but the speed during roll advancing is not changed—the twist profile shows somewhat of a decrease along the length of yarn. In FIG. 16B, the yarn velocity is gradually increased to the maximum velocity over the roll advancing portion of the cycle (~50%). This results in a more severe twist decrease along the yarn length. In FIG. 16C, the yarn velocity is accelerated as in FIG. 16A, but is then decreased gradually in the roll advancing portion of the cycle in a manner similar to that shown in FIG. 9. This results in a more uniform twist level, and produces the desired square wave twist distribution.

EXAMPLE 6

At process conditions similar to Example 5 wherein the total cycle time is 413 m sec. and wherein the feed yarns are 1245 denier having a denier per filament of 19 and a square cross section with rounded corners and four continuous voids, the percentage of satisfactorily bonded nodes is 98.6% to 99.3%. Water is applied to both yarns after tensioners 16 using finish applicator 17 (FIG. 1) so that the yarn feels damp to touch. The percentage of satisfactorily bonded nodes increases to about 99.9%.

The method of the invention is useful for producing long twist reversal lengths which is especially desirable in alternate twist plied carpet yarns. In Example 1, for instance, the number of turns of ply twist averaged about 200–230 and in Example 5 it averaged about 250–260. The stop-and-go nature of the process also favors a long reversal length so the yarn speed is high for a longer part of the machine cycle and the start/stop frequency of the apparatus elements is low to reduce wear and tear. It is preferred, then, that the reversal length is at least about 100 turns, and more preferably 200 turns.

While the preferred embodiment of the invention has been described in terms of twisting a plurality of strands in the same direction, plying the twisted strands, clamping and bonding the plied twisted strands, then repeating the steps while twisting the strands in the opposite direction, it has been observed that as long as the twist in the single yarn strands is changed in some way from one node (or machine half-cycle) to the next, the yarns will ply together forming an alternate twist plied yarn. For instance, the strand twist in the first half-cycle can be a high "S" twist followed by a low "S" twist in the second half-cycle which will produce a low ply twist level in the yarn; the strand twist can be a high "S" twist followed by no twist which will produce a low/medium ply twist in the yarn; or the strand twist can be a low "S" twist followed by a high "Z" twist which produces a medium/high ply twist. For a high ply twist level, the preferred operation is to have the strand twist be a high "S" twist followed by a high "Z" twist. From one half-cycle to the next, however, it is only necessary that some change in strand twist occur which may be a change in level in the same direction, or a change in direction at the same level, or a combination of change in both level and direction.

While the preferred embodiment of the invention utilizes ultrasonic energy to bond the plied yarns together, one skilled in the art may apply other sources of energy such as radiant energy from lasers or other sources. Also, other means of bonding such as adhesives or filament entanglement may be employed. The bonds in any case should be small (less than the length of one turn of ply twist), strong (about 25% of the singles yarn strength or greater) to ensure high reliability, and should be made with the yarns squeezed together with the strands at an angle to each other as in the plied condition.

While the preferred embodiment of the invention describes a process of bonding alternate twist plied yarn in the plied state as part of a stop-and-go process, it is within the capabilities of one skilled in the art to practice plied yarn bonding in a continuous process. Such a process may be achieved, for example, by modifying the embodiment described herein by providing means to transport the ultrasonic bonder at a speed equal to a continuously moving yarn speed determined by the continuously rotating puller rolls. When it is desired to bond the plied yarn to form a node, the transport means would accelerate the bonder rapidly to reach and maintain the speed of the yarn. The bonder and twist jets would then operate as previously described when there is no relative motion between the yarn and the bonder. After releasing the yarn, the bonder would be rapidly reset to its start position by the transport means, ready for the next bond. The transported distance of the bonder should be as short as possible. Other methods of achieving no relative motion between the yarn and bonder may also be possible to achieve bonding of plied yarn in a process where the yarn is continuously moving.

We claim:

1. An alternate twist plied yarn formed from a plurality of strands ply twisted in alternating directions in lengthwise intervals of first half-cycles of ply-twist followed by second half-cycles of ply-twist between reversal nodes, there being a bond formed adjacent each node wherein the first half-cycle of ply-twist is located within the bond and the second half-cycle of ply-twist originates at one end of the bond.

2. The twist plied yarn of claim 1 wherein the length of each node is less than two diameters of said plied yarn.

3. The yarn of claim 1 wherein said strands are bulked continuous filament yarn of equal denier.

4. The yarn of claim 3 wherein the lengths of said strands are substantially equal.

5. The yarn of claim 1 wherein said yarn has a torsional stability of less than one turn per cm.

6. The yarn of claim 1 wherein the ratio of the average twist to the twist of each strand is greater than 0.6.

7. The yarn of claim 1 wherein the strength of the bond is at least 50 percent of a single strand of yarn.

8. The yarn of claim 1 wherein the strands are bonded together adjacent said node at an angular relationship to each other.

9. An alternate ply-twisted yarn formed from a plurality of strands ply twisted in alternating directions in lengthwise intervals of first half-cycles of ply-twist followed by second half-cycles of ply-twist between reversal nodes, there being a bond formed adjacent each node wherein the first half-cycle of ply-twist is located within the bond and the second half-cycle of ply-twist originates at one end of the bond, said yarn having an average length for each turn of ply-twist, the average bond length of said bonded reversals being less than the average length of one turn of ply-twist.

10. The yarn as defined in claim 9 wherein the length of the reversal node is less than two of said lengths of turns of ply-twist.

11. An alternate twist plied yarn formed from a plurality of bulked continuous yarn strands of equal denier and substantially equal length strands twisted in alternating directions in lengthwise intervals between reversal nodes there being a bond formed adjacent each node wherein the center of the bond is not aligned with the center of the reversal node, said reversal node having a length less than two diameters of said plied yarn, said yarn having a torsional stability of less than one turn per cm.

12. The yarn of claim 11 wherein the strength of the bond is at least 50 percent of a single strand of yarn.

13. The yarn of claim 11 wherein the strands are bonded together adjacent said node at an angular relationship to each other.

* * * * *

UNITED STATES PATENT AND TRADEMARK OFFICE

CERTIFICATE OF CORRECTION

PATENT NO. : 5,012,636

DATED : May 7, 1991

INVENTOR(S) : Donald Earl Hallam, et al.

It is certified that error appears in the above-identified patent and that said Letters Patent is hereby corrected as shown below:

Col. 3, line 31, after "between" insert --which there are--.

Col. 25, line 31, after "between" insert --which there are--.

Col. 26, line 15, after "between" insert --which there are--;
line 29, after "between" insert --which there are--.

Signed and Sealed this

Twenty-fourth Day of November, 1992

*Attest:*

DOUGLAS B. COMER

*Attesting Officer*

*Acting Commissioner of Patents and Trademarks*